US011407251B2

(12) United States Patent
Bentley

(10) Patent No.: US 11,407,251 B2
(45) Date of Patent: Aug. 9, 2022

(54) PAINT ROLLER COVER CLEANER

(71) Applicant: ROLLER BLASTER LIMITED, Feilding (NZ)

(72) Inventor: Stephen Robert Bentley, Feilding (NZ)

(73) Assignee: ROLLER BLASTER LIMITED, Feilding (NZ)

( * ) Notice: Subject to any disclaimer, the term of this patent is extended or adjusted under 35 U.S.C. 154(b) by 169 days.

(21) Appl. No.: 16/905,737

(22) Filed: Jun. 18, 2020

(65) Prior Publication Data

US 2020/0331288 A1 Oct. 22, 2020

Related U.S. Application Data

(63) Continuation-in-part of application No. 15/576,756, filed as application No. PCT/NZ2016/050093 on Jun. 3, 2016, now Pat. No. 10,722,905.

(30) Foreign Application Priority Data

Jun. 4, 2015 (NZ) ..... 708805

(51) Int. Cl.
*B44D 3/00* (2006.01)
*B08B 3/02* (2006.01)

(52) U.S. Cl.
CPC ..... *B44D 3/006* (2013.01); *B08B 3/02* (2013.01)

(58) Field of Classification Search
CPC ..... B44D 3/006
See application file for complete search history.

(56) References Cited

U.S. PATENT DOCUMENTS

| | | | |
|---|---|---|---|
| 2,121,866 | A | 6/1938 | Fredrikson |
| 2,725,065 | A | 11/1955 | Wilsing |
| 2,938,368 | A | 5/1960 | Bixel |
| 2,994,482 | A | 8/1961 | Valois et al. |
| 3,037,516 | A | 6/1962 | Leach |
| 3,075,534 | A | 1/1963 | Habostad |
| 3,087,190 | A | 4/1963 | Werner |
| 3,133,548 | A | 5/1964 | Carr |
| 3,422,828 | A | 1/1969 | Dommer |
| 3,462,300 | A | 8/1969 | Hocutt |
| 3,472,251 | A | 10/1969 | Parker, Jr. |
| 3,755,840 | A | 9/1973 | Barger |

(Continued)

FOREIGN PATENT DOCUMENTS

| | | |
|---|---|---|
| DE | 2360884 A1 | 6/1975 |
| DE | 3528951 A1 | 3/1986 |

(Continued)

*Primary Examiner* — Jason Y Ko
(74) *Attorney, Agent, or Firm* — Thomas Coester Intellectual Property

(57) ABSTRACT

A paint roller cover cleaner for cleaning a paint roller cover. The paint roller cover cleaner has one or more nozzles that spray the cover and that may each produce a fan-shaped jet in a plane that is at an angle to the longitudinal axis of the roller cover. The paint roller cover cleaner may also have a clamp for clamping a handle of the paint roller, another nozzle for cleaning an enclosure of the paint roller cover cleaner, a lid for the enclosure that drips within the mouth of the enclosure and does not move laterally across the roller cover to open. A system including a paint roller cover cleaner and a fluid supply that can contain the paint roller cover cleaner is also provided.

9 Claims, 21 Drawing Sheets

(56) References Cited

U.S. PATENT DOCUMENTS

| | | | | | |
|---|---|---|---|---|---|
| 3,873,364 | A | | 3/1975 | Smith | |
| 4,294,272 | A | | 10/1981 | Klaiber | |
| 4,311,158 | A | | 1/1982 | Harvey | |
| 4,402,333 | A | | 9/1983 | Frizzell et al. | |
| 4,549,562 | A | | 10/1985 | Ossi | |
| 4,735,221 | A | | 4/1988 | Vegiard | |
| 5,005,598 | A | | 4/1991 | Hodgdon | |
| 5,050,626 | A | | 9/1991 | Brockage et al. | |
| 5,095,928 | A | | 3/1992 | Phipps | |
| 5,413,133 | A | | 5/1995 | Russell | |
| 5,626,158 | A | * | 5/1997 | Gratopp | B44D 3/006 134/900 |
| 5,651,381 | A | | 7/1997 | Balouchian | |
| 5,816,275 | A | | 10/1998 | Mullen | |
| 5,839,459 | A | | 11/1998 | Bisby | |
| 5,935,342 | A | | 8/1999 | Boyd | |
| 6,019,111 | A | * | 2/2000 | Gillies | B44D 3/006 134/900 |
| 6,363,954 | B2 | | 4/2002 | Bastien | |
| 6,408,862 | B1 | | 6/2002 | van Rooyen | |
| D467,049 | S | | 12/2002 | Kohn | |
| 7,640,941 | B2 | | 1/2010 | Watters et al. | |
| 7,806,129 | B2 | | 10/2010 | Jabbar | |
| 7,900,642 | B2 | | 3/2011 | Lavender et al. | |
| 8,973,592 | B2 | | 3/2015 | Suydam | |
| 2004/0003835 | A1 | | 1/2004 | Higgins | |
| 2008/0078429 | A1 | | 4/2008 | Hoffmann | |
| 2008/0105284 | A1 | | 5/2008 | Bates | |
| 2015/0068561 | A1 | | 3/2015 | McClish et al. | |

FOREIGN PATENT DOCUMENTS

| | | | |
|---|---|---|---|
| DE | 19914185 | A1 | 9/2000 |
| GB | 2291792 | A | 2/1996 |
| GB | 2407486 | A | 5/2005 |
| JP | 2003001198 | A | 1/2003 |
| WO | 1993024337 | | 12/1993 |
| WO | 2006100469 | A3 | 5/2007 |

* cited by examiner

FIG. 16
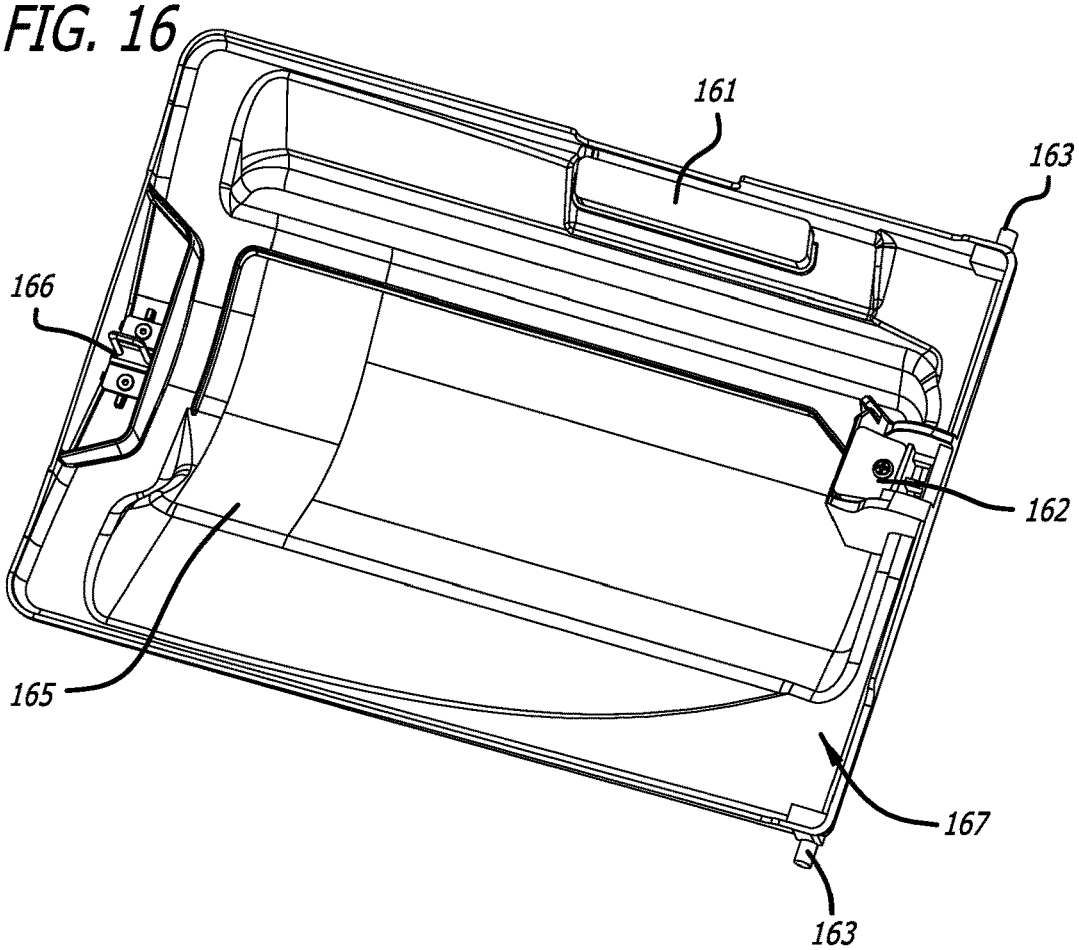
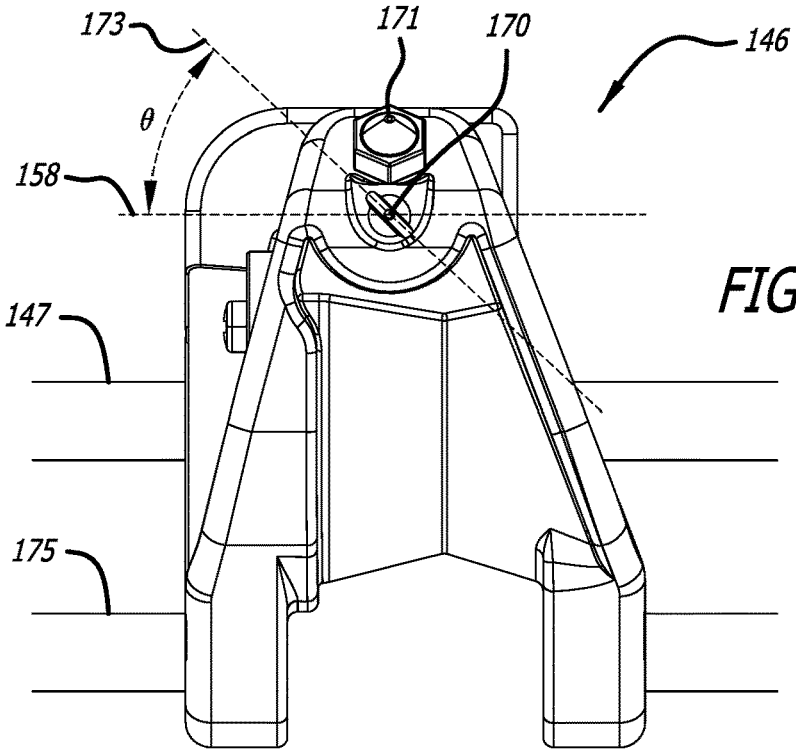
FIG. 17

PAINT ROLLER COVER CLEANER

FIELD

This invention relates to a paint roller cover cleaner. More particularly, although not exclusively, the invention relates to a paint roller cover cleaner which cleans a paint roller cover (also referred to as a "roller sleeve") using a high pressure jet within an enclosure. The invention also relates to a paint roller cover cleaner system.

BACKGROUND

The cleaning of paint roller covers manually is slow, messy and ineffective as well as being extremely wasteful of water. Many sites do not have a pressurised water supply and disposal of waste water is often also strictly regulated.

A number of paint roller cover cleaning devices have been proposed. Whilst some are more effective at cleaning paint roller covers than manual cleaning they all tend to be very wasteful of water, typically requiring between 20 to 300 litres of water to effectively clean a roller cover. They typically require a pressurised mains water source, which is often not available at a site to be painted. Mains water supplies whilst sometime referred to as "high pressure" supplies are typically well below 150 psi and so a substantial amount of water is required to properly clean a roller cover. This results in a substantial amount of waste water being produced (typically between 20 and 300 litres) so that it becomes impractical to contain the volume of waste water produced and transport it off site. The large volume of waste water also becomes very expensive to recycle as the coagulant cost is based on water volume. The low pressure of mains water supplies can also make it impractical to properly clean roller covers in some cases. Some devices require manual operation which can affect cleaning performance and is inconvenient.

SUMMARY

According to one exemplary embodiment there is provided a paint roller cover cleaner to clean a paint roller cover, the cleaner comprising:

an enclosure to receive a roller cover;

one or more nozzles supplied with fluid from a fluid supply, each nozzle configured to produce a fan-shaped jet that defines a plane, the plane intersecting a longitudinal axis of the roller cover at a substantial angle and positioned to direct a jet of fluid at the nap of the roller cover to rotate the roller cover and facilitate cleaning, wherein the one or more nozzles are arranged to sequentially direct the jet(s) at a plurality of positions along the roller cover to effect cleaning along the length of the roller cover.

According to another exemplary embodiment there is provided a paint roller cover cleaner to clean a paint roller cover on a paint roller handle, the cleaner comprising:

one or more nozzles supplied with high pressure fluid from a high pressure pump, each nozzle configured to produce a jet of fluid directed at the nap of the roller cover to rotate the roller cover and facilitate cleaning, wherein the one or more nozzles are arranged to sequentially direct the jet(s) of fluid at a plurality of positions along the roller cover to effect cleaning along the length of the roller cover; and a clamp configured to receive the paint roller handle so as to maintain the roller cover in a cleaning position, the clamp including a plurality of guides at a respective plurality of different points along the handle to restrict movement of the paint roller handle in at least two transverse directions.

According to another exemplary embodiment there is provided a paint roller cover cleaner comprising:

an enclosure for receiving a roller cover;

a roller cover-cleaning nozzle configured to direct a first jet of fluid at the nap of the roller cover to facilitate cleaning of the roller cover; and an enclosure-cleaning nozzle configured to direct a second jet of fluid at an inner surface of the enclosure for cleaning the enclosure;

wherein the enclosure-cleaning nozzle is configured to move about a cavity within the enclosure to direct the second jet of fluid at different areas of the interior of the enclosure.

According to another exemplary embodiment there is provided a paint roller cover cleaner comprising:

an enclosure for receiving a roller cover;

a nozzle configured to direct a jet of fluid at the nap of the roller cover to facilitate cleaning of the roller cover; and a lid coupled to the body of the paint roller cover cleaner such that it can move between a closed position in which it closes a mouth of the enclosure and an open position in which it does not close the mouth of the enclosure;

wherein in the open position a lower portion of an inner surface of the lid is aligned with the mouth of the enclosure so that fluid falling from the lower portion will fall into a cavity within the enclosure.

According to another exemplary embodiment there is provided a paint roller cover cleaner comprising:

an enclosure for receiving a roller cover;

a nozzle configured to direct a jet of fluid at the nap of the roller cover to facilitate cleaning of the roller cover; and a lid coupled to the body of the paint roller cover cleaner such that it can move between a closed position in which it closes a mouth of the enclosure and an open position in which it does not close the mouth of the enclosure;

wherein the path of movement of the lid from the closed position to the open position is substantially parallel to a plane defined by a longitudinal axis of the roller cover and the vertical direction.

According to another exemplary embodiment there is provided a paint roller cover cleaner system comprising:

a paint roller cover cleaner comprising an enclosure that may be opened to place a roller cover within the enclosure and closed to contain the roller cover within; and a fluid supply reservoir having an internal cavity dimensioned to accommodate the roller cover cleaner within the enclosure and an outlet coupling configured to connect with an inlet coupling of the roller cover cleaner to supply fluid to the roller cover cleaner in use.

Embodiments may be implemented according to any one of the dependent claims 2 to 13, 15 to 20, 22 to 29, 31 to 32, and 34 to 35.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e., they will be taken to mean an inclusion of the listed components which the use directly references, and possibly also of other non-specified components or elements.

Reference to any document in this specification does not constitute an admission that it is prior art, validly combinable with other documents or that it forms part of the common general knowledge.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention, in which:

FIG. 16 is a perspective view of the underside of the lid of the paint roller cover cleaner of FIG. 13;

FIG. 17 is a front view of a spray assembly according to one embodiment;

DETAILED DESCRIPTION

The invention generally relates to a paint roller cover cleaner, and in one particular embodiment, to a roller cover cleaner which cleans a paint roller cover using a high pressure jet within an enclosure. The enclosure may allow both supply and waste fluid to be contained within. A nozzle producing a high pressure jet is attached to a carriage which traverses the length of the paint roller cover. A pump supplies the nozzle with high pressure fluid, and it is then positioned to direct a jet of fluid at the nap of the roller cover, causing the roller cover to rotate. The high pressure and induced rotation leaves the roller cover clean and dry, allowing immediate reuse. Waste fluid is drained to an internal or external container for recycling. The high pressure cleaning means that only a small volume of water is used per clean, making transportation within the enclosure and recycling practical.

Figure 1:
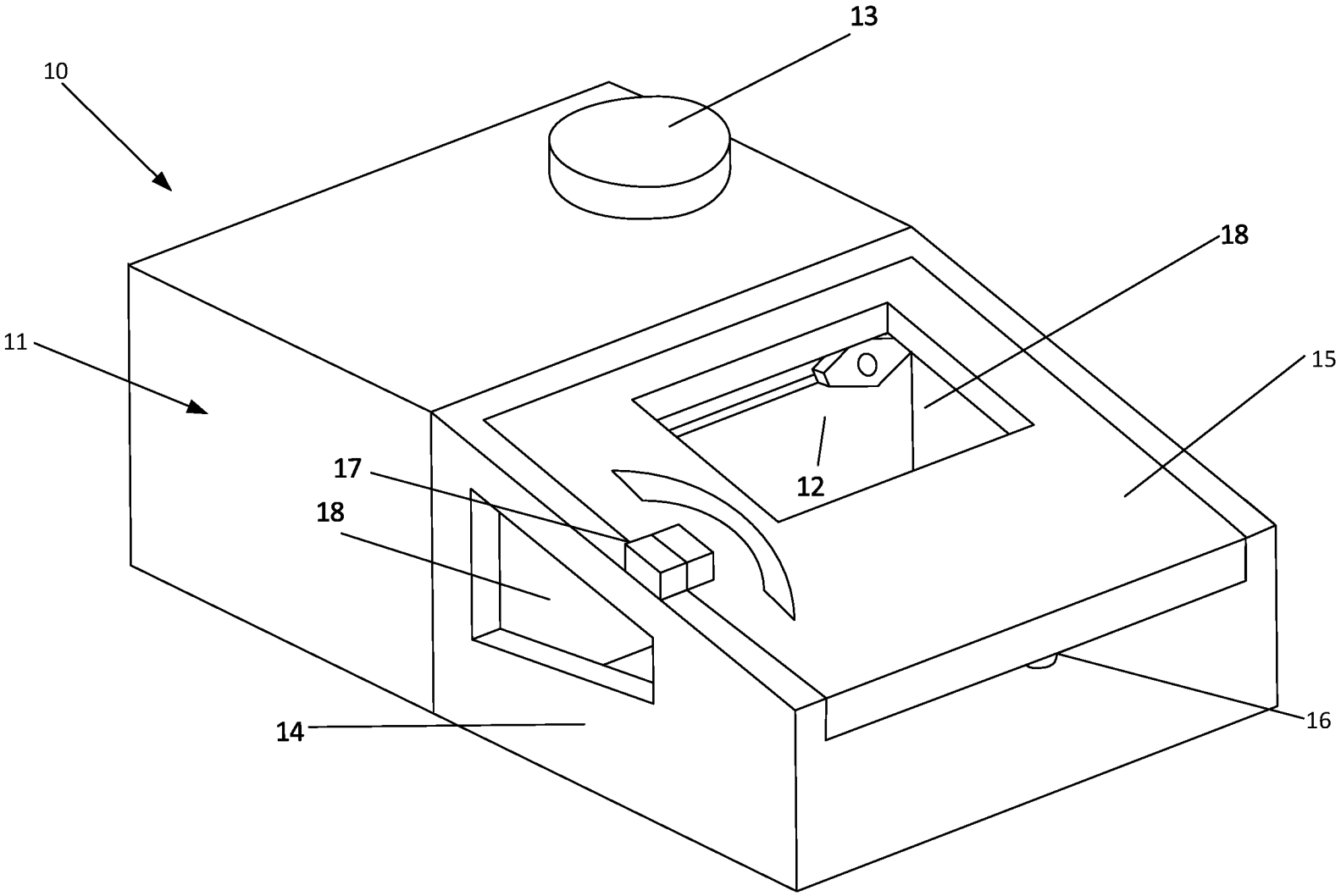
FIG. 1 is a perspective view of a paint roller cover cleaner according to one embodiment with the lid closed.

A paint roller cover cleaner according to one embodiment 10 is shown with the lid closed in FIG. 1. The back operating region 11 of the enclosure contains reservoirs for both supply and waste fluid, along with a pump and motor to provide water pressure and drive the carriage 12. There is an inlet with a cover 13 for filling the device with the supply fluid, typically water. The front cleaning region 14 of the enclosure receives a paint roller cover to be cleaned. The lid 15 secures the paint roller handle in a groove 16, in the body of the enclosure 14 and is held closed by a latch 17 to ensure all fluid is contained when cleaning is in progress. A transparent viewing panel 18 may be provided to allow observation of the cleaning process.

Figure 2:
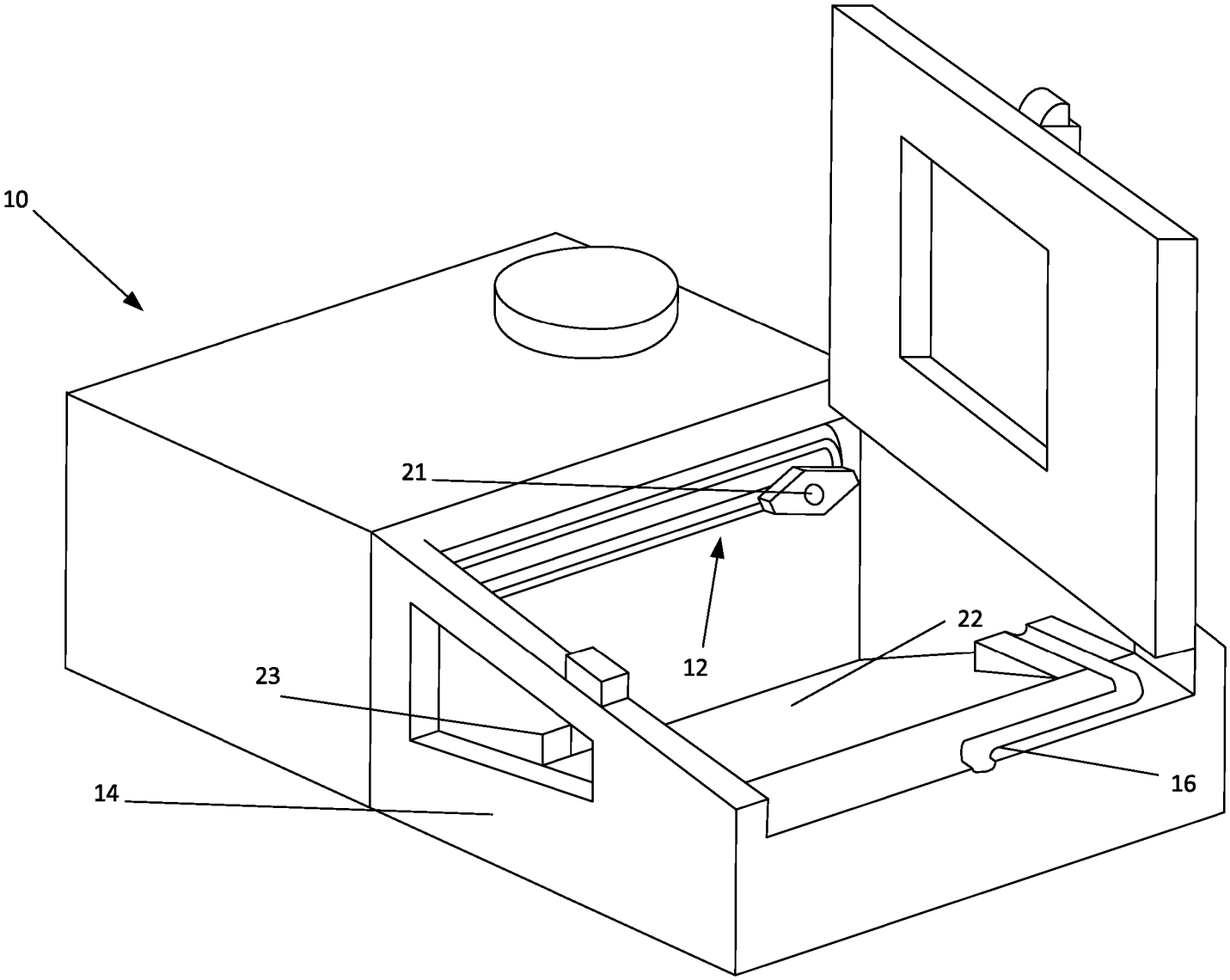
FIG. 2 is a perspective view of the paint roller cover cleaner as shown in FIG. 1 with the lid open.

FIG. 2 shows the internal configuration when the lid of the enclosure is open. The groove 16 follows the shape of a roller handle for a secure fit and may be designed to fit several different shapes of roller handle. Securely holding the roller cover in place is important for effective cleaning. A cleaning fluid is distributed along the length of the roller cover by a nozzle 21 attached to a sliding carriage 12. The nozzle 21 is supplied with pressurized fluid and positioned to direct a jet of fluid at the nap of the roller cover, causing the roller cover to rotate. The nozzle 21 is preferably directed generally tangentially to the nap to produce rotation. The jet of fluid may be a fan jet that is about 2 cm wide. The fan jet is preferably inclined to the axis of the roller cover so that it can effectively clean the entire nap of the roller cover. Preferably the jet is inclined at an angle of between 5 to 50 degrees with respect to the axis of the roller cover, more preferably about 35 degrees. The angle of inclination of the fan jet to the roller cover could be adjustable to allow a user to set this for the particular type of roller being cleaned. This creates a high pressure jet that provides coverage of the entire nap.

The carriage 12 moves the nozzle along the length of the roller cover to effect cleaning along the length of the roller cover. The base 22 is inclined so that the waste fluid drains to an inlet 23 for a waste fluid reservoir. Due to the high speed rotation of the roller cover, virtually all paint and supplied liquid is expelled. This leaves the roller cover almost completely dry and free from paint residue so that a painter may reuse it immediately without cross contamination of paints.

Figure 3:
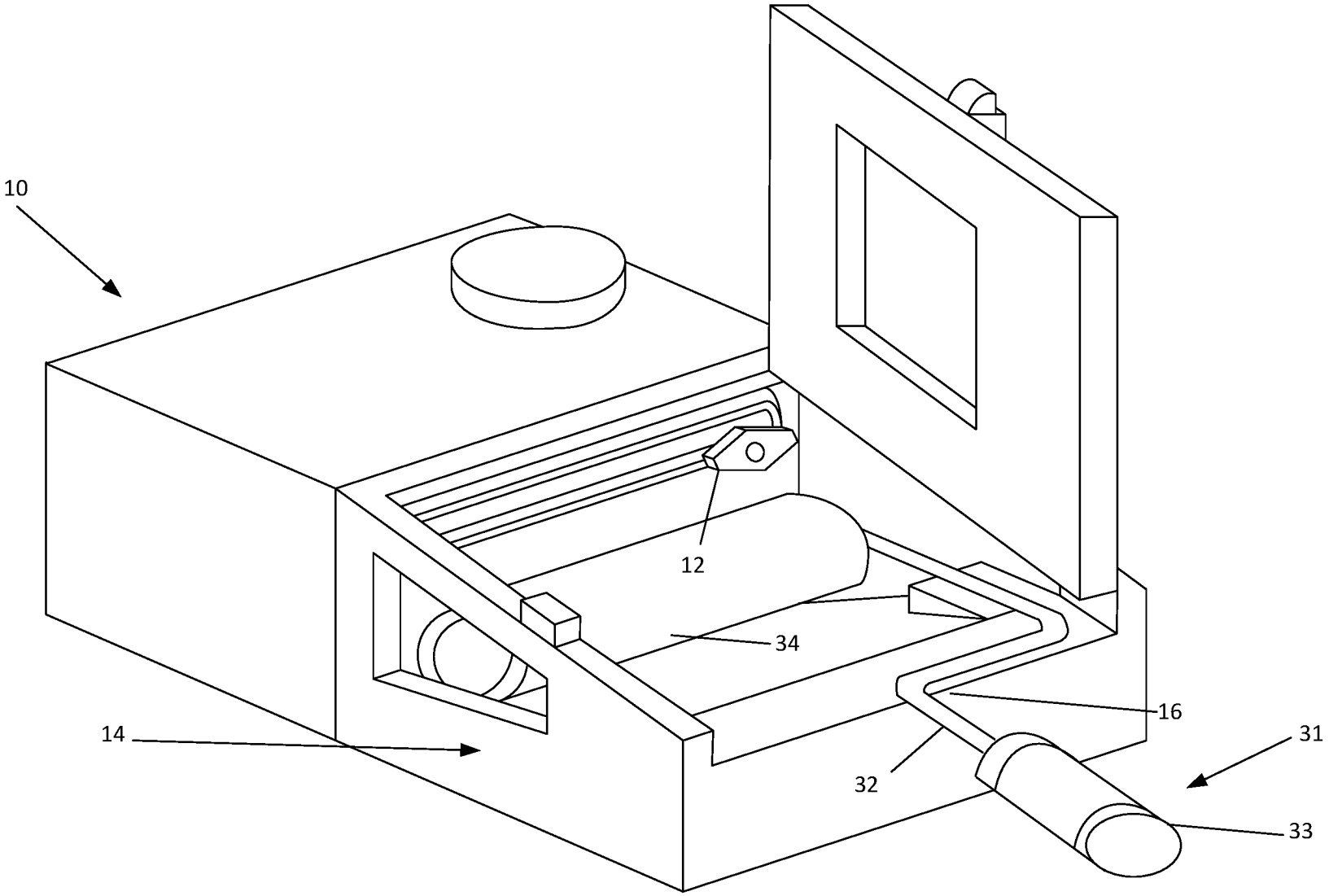
FIG. 3 is a perspective view of the paint roller cover cleaner as shown in FIG. 1 with the lid open, and a paint roller cover positioned inside.

The position of an example roller cover 31 inside the roller cover cleaner is shown in FIG. 3. The roller handle 32 rests in a groove 16 to hold the roller cover in the desired position, allowing tight clamping to withstand high pressure cleaning. By providing the handle clamp opposite nozzle 21 the roller cover 34 is stabilised against the force of the jet from nozzle 21. At least a portion of the handle 33 is kept outside the enclosure so that it remains dry. The roller cover 34 may be kept on the handle 32, avoiding the inconvenience of removal. The roller cover 34 is also completely enclosed during cleaning, so that any fluid from the high pressure cleaning is contained. The front section 14 may be adapted to fit roller covers of various widths and diameters and the groove 16 may support roller handles of various shapes.

Figure 4:
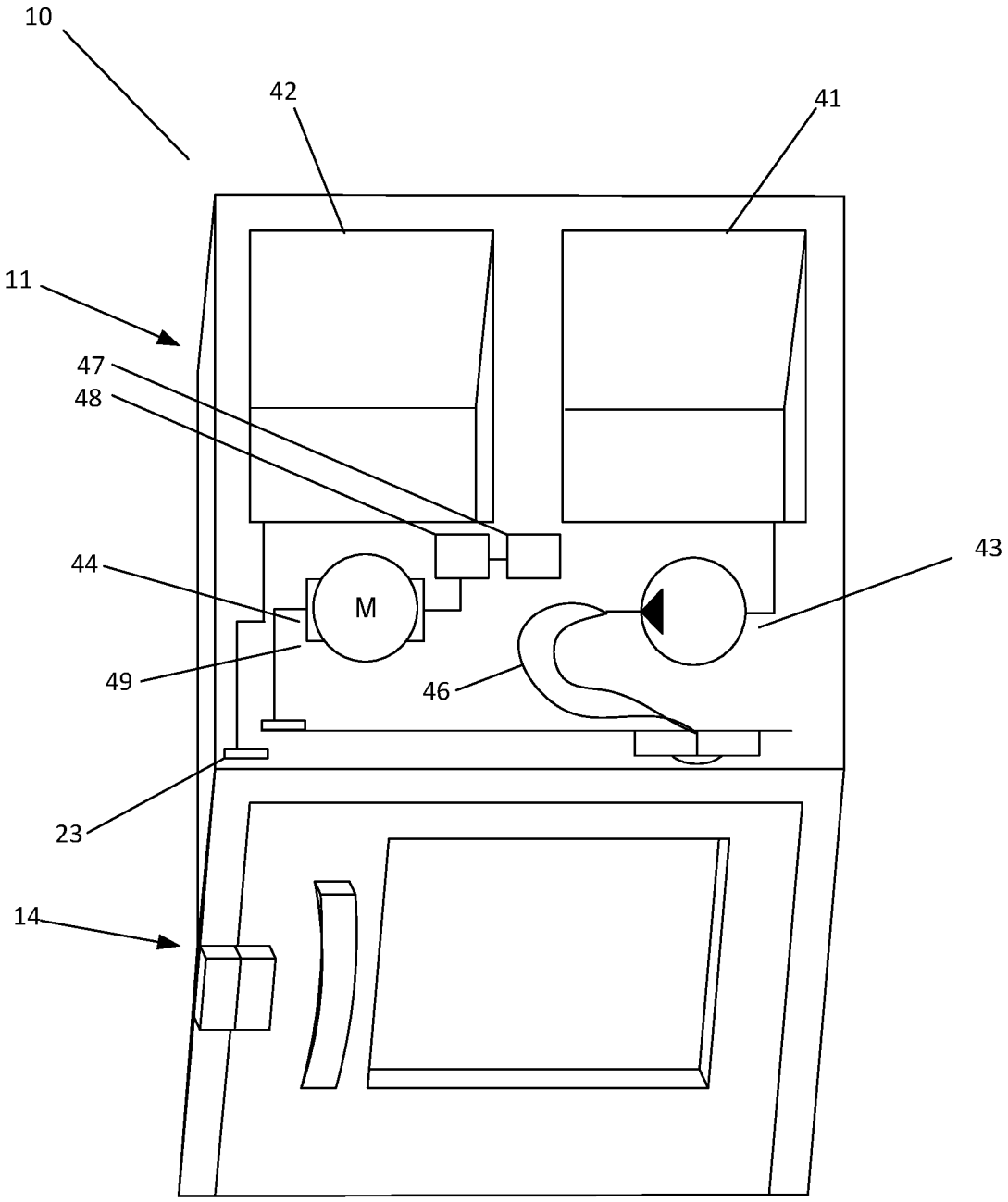
FIG. 4 is a plan view of the internal components of a paint roller cover cleaner, according to one embodiment.
Figure 5:
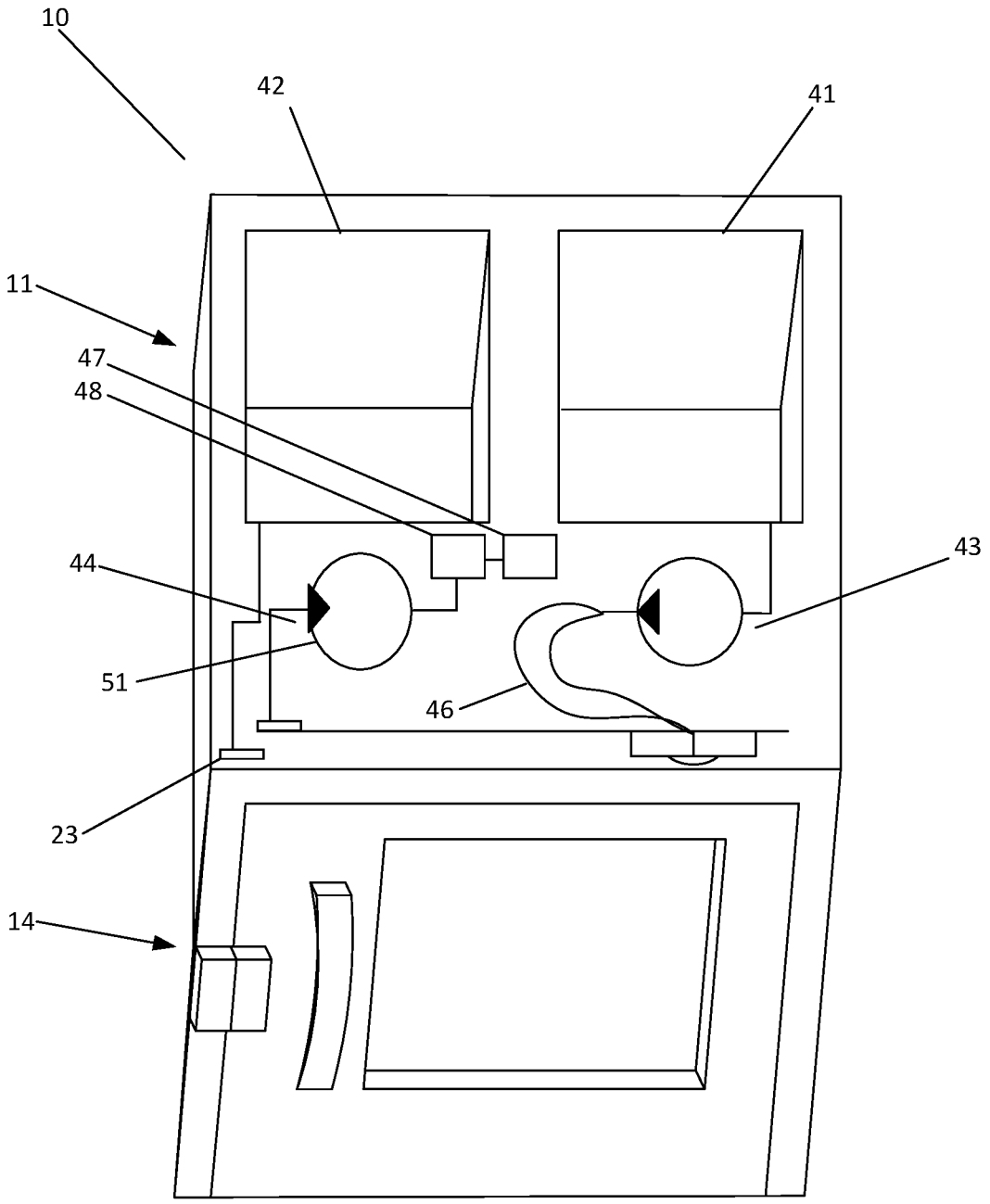
FIG. 5 is a plan view of the internal components of a paint roller cover cleaner, according to another embodiment.
Figure 6:
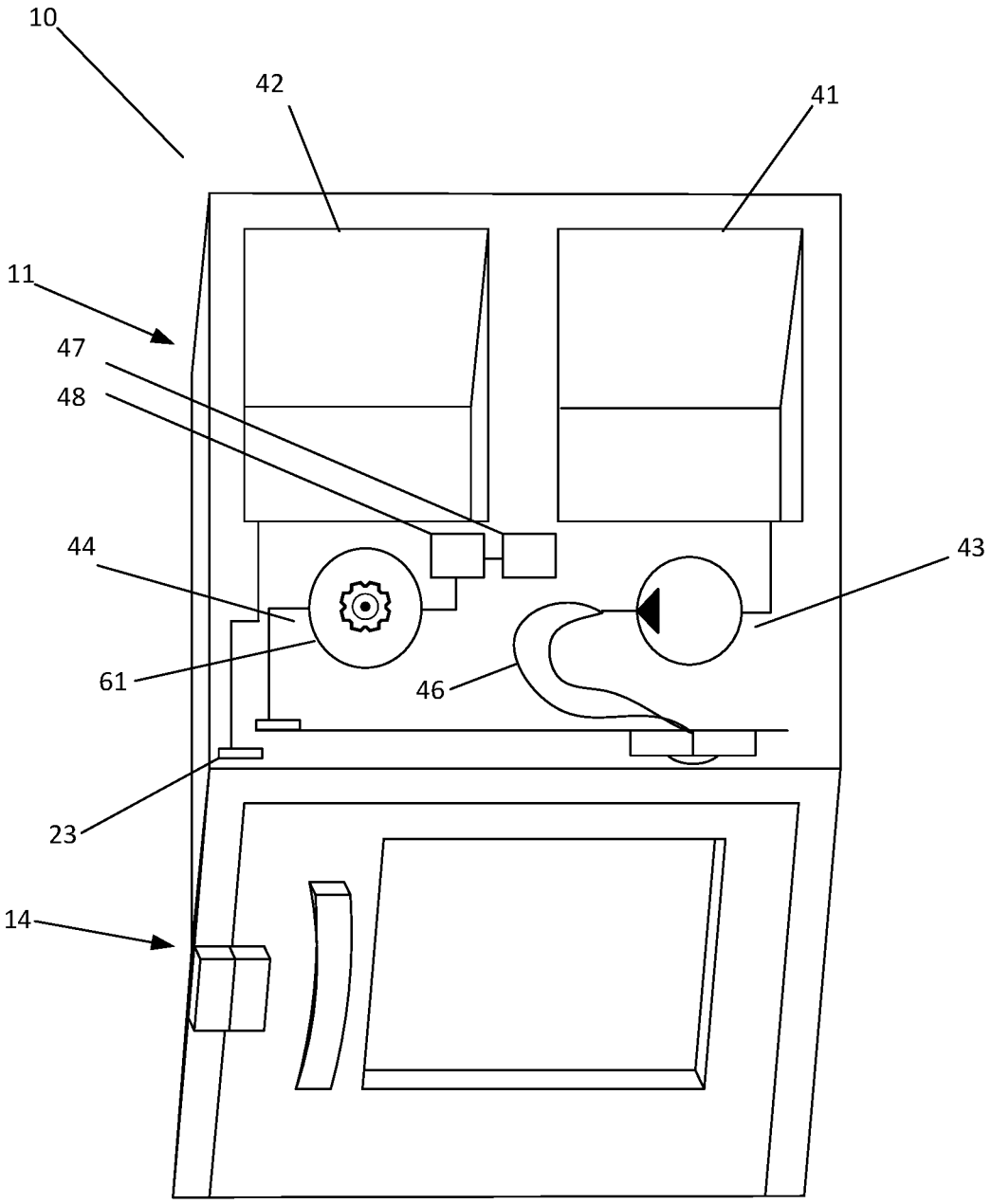
FIG. 6 is a plan view of the internal components of a paint roller cover cleaner, according to a further embodiment.

FIGS. 4-6 show schematic diagrams of several different possible configurations. All embodiments have a supply fluid reservoir 41, a waste fluid reservoir 42, a high pressure pump 43 and a means of driving the carriage 44. A control system 47 and driver circuit 48 control the operation of the carriage driving means 44. Cleaning fluid is supplied to the high pressure pump 43 from the supply fluid reservoir 41. Waste fluid is drained from the front section 14 to the waste fluid reservoir 42 through an inlet 23 for later recycling, which may be done off site. A pump may be provided to transfer waste fluid from inlet 23 to reservoir 42 if desired. Typically, less than 4 litres of water is used to clean one roller cover, due to the high pressure of the water. This is significantly less than the 20 to 300 litres of previous paint roller cover cleaning devices. The amount of water used makes recycling viable, as it is contained, transportable and a comparatively small volume.

The pump 43 may be internal as shown or externally coupled to the unit. Preferably the pump is self-priming and piston type. For adequate cleaning of the paint roller cover, the pump should produce a fluid supply at a pressure between 200 and 4000 psi (or between about 1400 kPa and about 28000 kPa). Preferably the pump will produce a fluid supply at a pressure between 500 and 2000 psi (or between about 3400 kPa and about 14000 kPa). The integrated pump removes reliance on the pressure of tap water or another pressurized water supply for an effective clean.

The means of driving the carriage 44 differ between the embodiments of FIGS. 4-6. FIG. 4 shows an electric motor 49 as the means of driving the carriage via a suitable mechanical drive, such as those employed in printers. Alternatively, a hydraulic motor 51 may be used, as shown in FIG. 5. The hydraulic motor may be connected to the pressurized fluid supply 46. The carriage may also be driven by mechanical means 61, as shown in FIG. 6.

Figure 7:
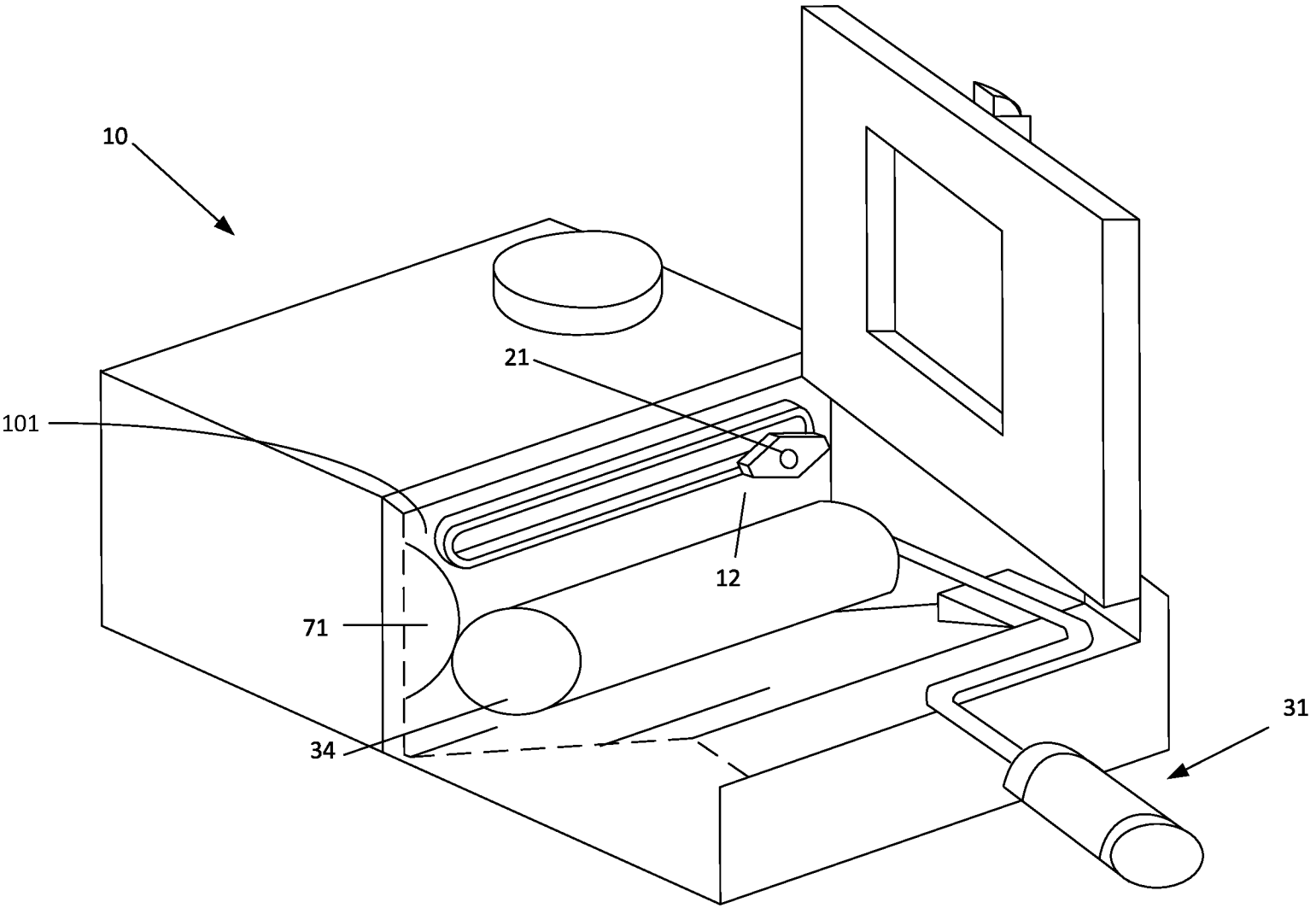
FIG. 7 is a cutaway view of a paint roller cover cleaner employing a mechanically driven carriage.

A friction drive may be used to utilize the rotation of the roller cover while it is being cleaned to drive the carriage. An example friction drive configuration is shown in FIG. 7. As the high pressure jet 21 rotates the roller cover 34, the rotational motion is transferred to the wheel 71 as they are in contact. The size of the wheel 71 may be chosen to provide an appropriate carriage speed from the transfer of the rotational motion. The friction between the roller cover 34 and the wheel 71 should not inhibit the rotation of the roller cover or shield the end of the roller cover from the movement of the carriage 12, preventing cleaning.

Figure 8:
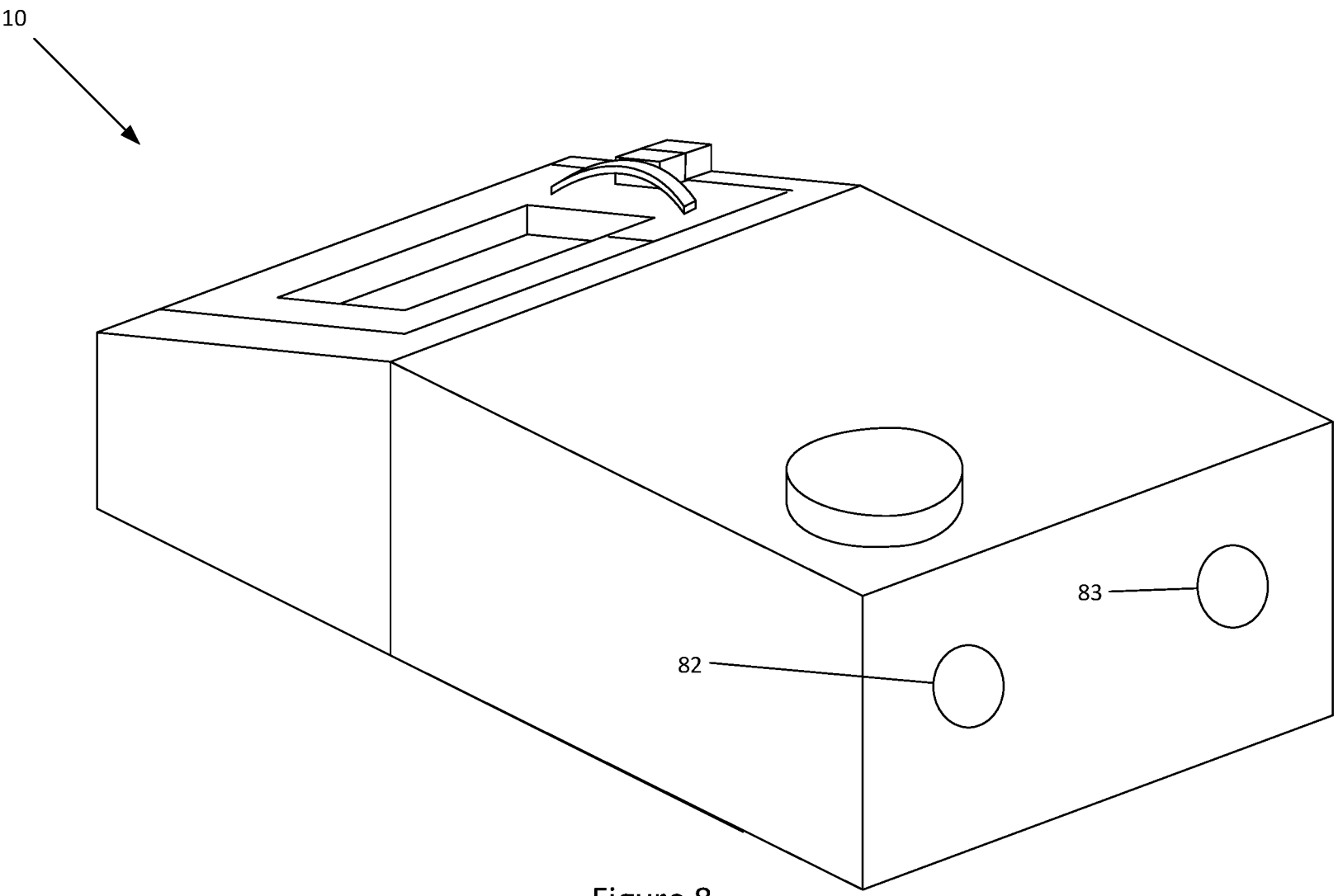
FIG. 8 is a back view of a paint roller cover, according to an alternative embodiment.

FIG. 8 shows an alternative embodiment where external reservoirs and an external pump may be used. Fluid coupling 81 allows for the attachment of a pressurized external fluid source, whilst coupling 82 supplies waste fluid to an external reservoir. When these fluid couplings are present, the internal reservoirs and pump may still be present, and an appropriate plug may be used to seal the couplings 81 and 82 when not required.

Figure 9:
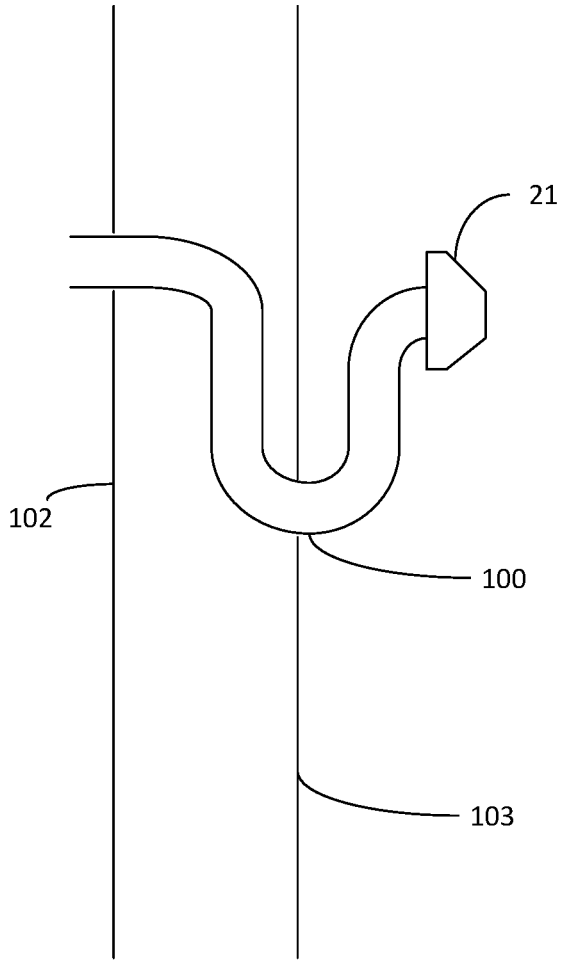
FIG. 9 is a side view of a fluid supply conduit including a U bend.
Figure 10:
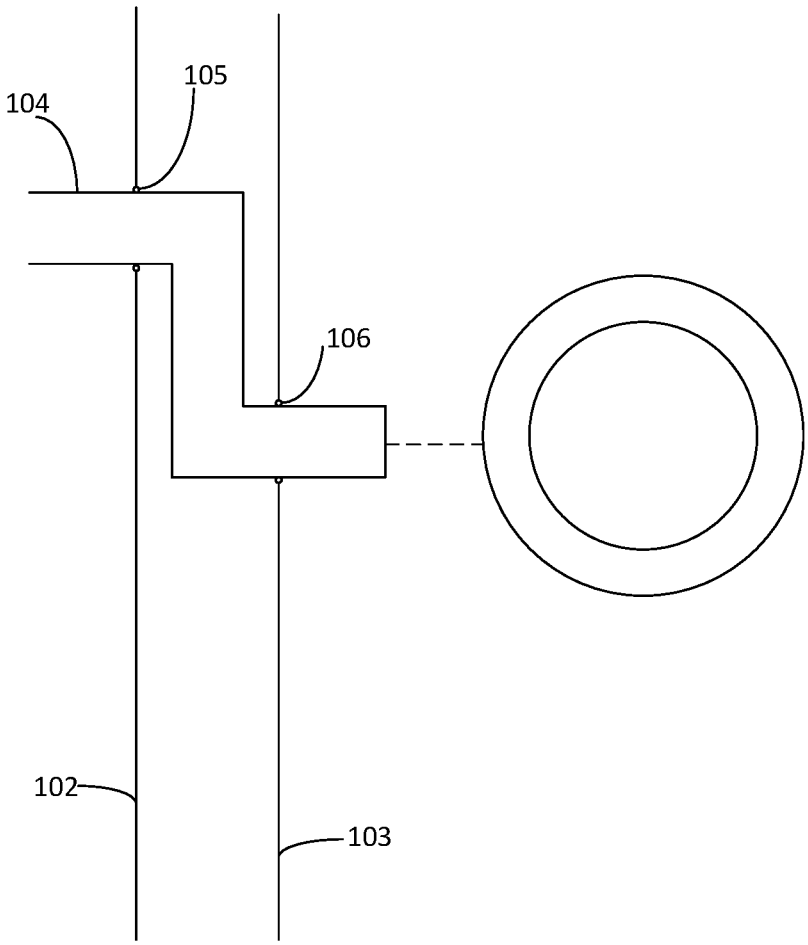
FIG. 10 is a side view of a barrier having vertically offset apertures for a fluid supply conduit.

FIG. 9 shows a fluid supply conduit 100 for supplying pressurized fluid to nozzle 21 having a U bend to reduce water egress from the cleaning region 14 to the operating region 11 through a barrier 101—in this case in the form of dual walls 102 and 103. FIG. 10 shows another arrangement having spaced apart walls 102 and 103 having vertically offset apertures 105 and 106 for fluid supply conduit 104. In this way any fluid entering aperture 106 drops down in between walls 102 and 103.

Figure 11:
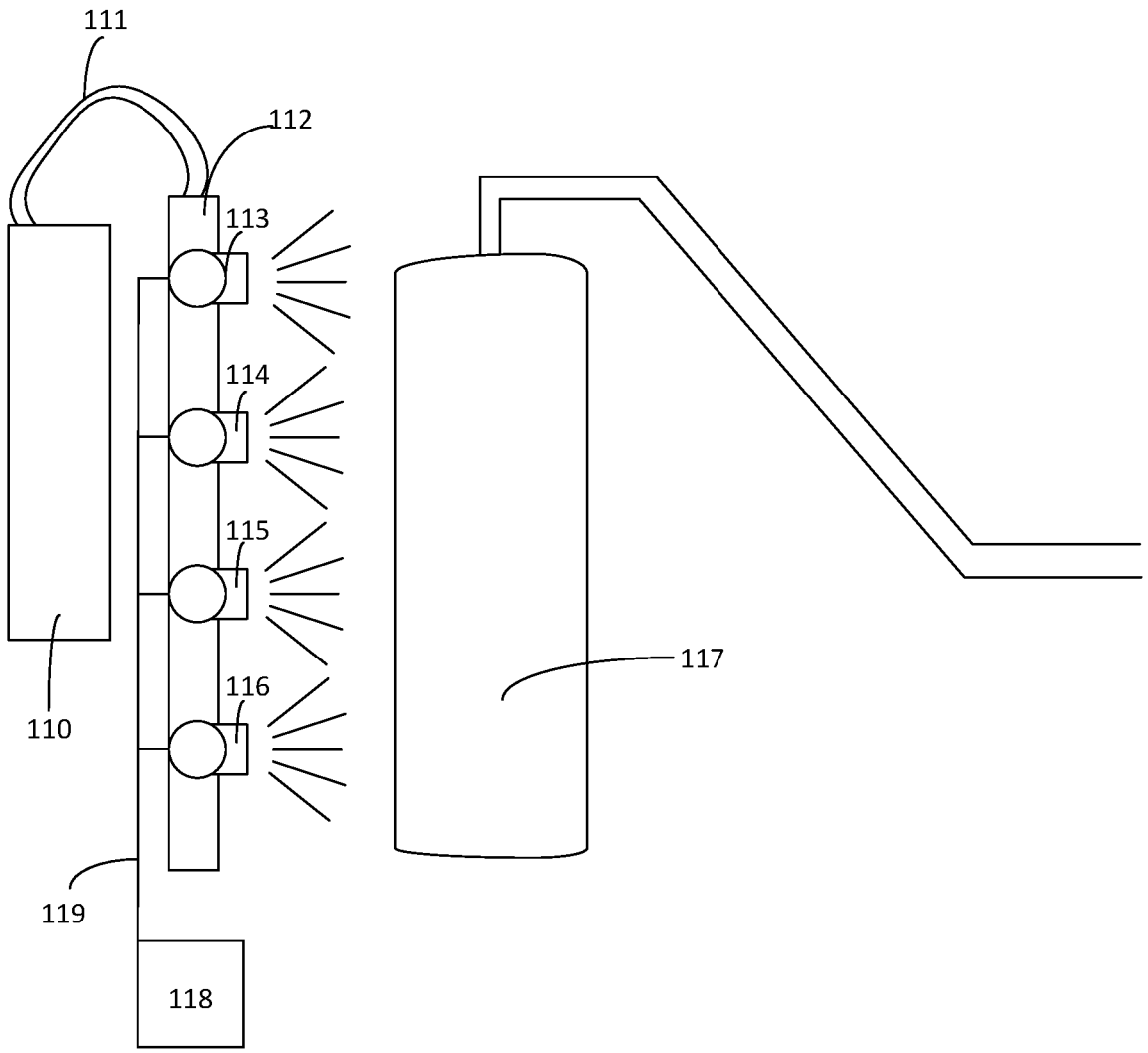
FIG. 11 is a top view of a paint roller cleaning nozzle arrangement, according to another alternative embodiment.

Referring now to FIG. 11 a schematic view of paint roller cover cleaner shows a high pressure pump supplying pressurized fluid to a manifold 112 via a conduit 111. A plurality of controllable nozzles 113 to 116 receive pressurized fluid from manifold 112. The controllable nozzles may be sequentially activated to sequentially clean sections of roller cover 117. In this case the controllable nozzles include solenoid valves which are sequentially activated via control lines 119 from controller 118. This simplifies the mechanical arrangement but does require multiple controllable nozzles.

FIGS. 12*a* to 12*d* show a further arrangement for producing cleaning jets along the length of a roller cover. FIG. 12 a shows a side view in which an outer tubular sleeve 121 is rotatably mounted about an inner tubular sleeve 120. As shown in the embodiment shown in plan in FIG. 12*b* the inner sleeve 120 has a plurality of apertures 122 (only one of which is indicated) provided along its length. As shown in the embodiment shown in plan in FIG. 12*c* the outer sleeve 121 has a spiral slot 123 provided along its length. When outer sleeve 121 is rotated about inner sleeve 120 it will be appreciated that apertures 122 will sequentially be aligned with slot 123 so as to sequentially produce a jet from one (or possibly multiple) of the apertures 122. The sleeves are arranged parallel to and spaced apart from a roller cover so that they form a nozzle with sequentially activated jets alone the sleeves progressively cleaning sections of the roller cover as it spins due to the force of the jets.

Figure 12A:
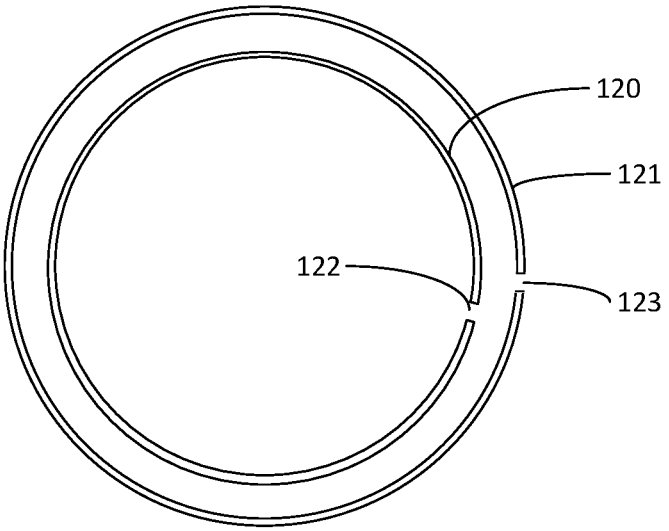
FIG. 12*a* is a side view of a paint roller cleaning nozzle, according to a further alternative embodiment.
Figure 12B:
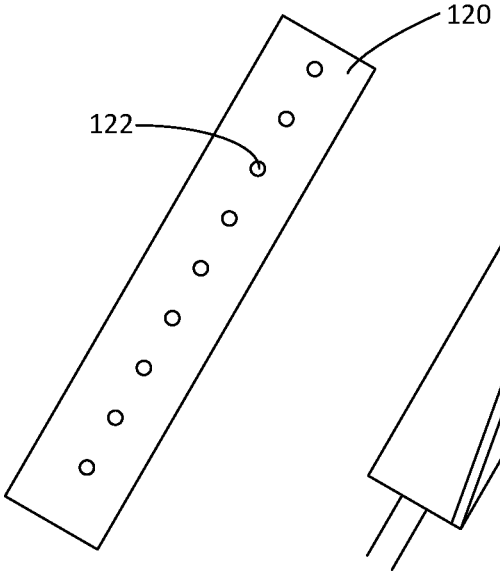
FIG. 12*b* is a top view of a paint roller cleaning nozzle inner sleeve.
Figure 12C:
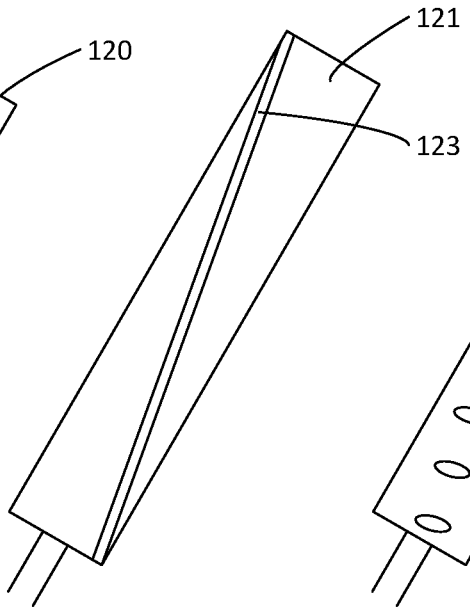
FIG. 12*c* is a top view of a paint roller cleaning nozzle outer sleeve, according to one embodiment.
Figure 12D:
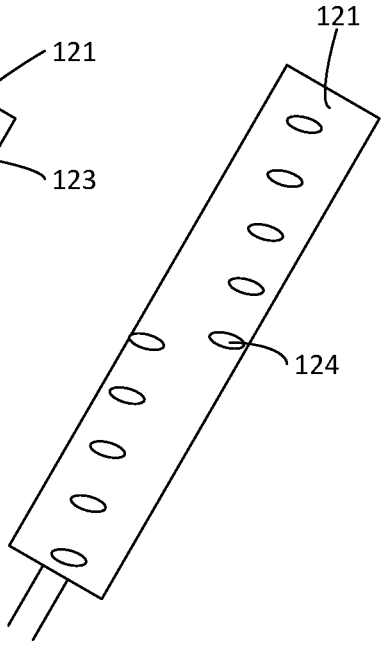
FIG. 12*d* is a top view of a paint roller cleaning nozzle outer sleeve, according to another embodiment.

It will be appreciated that the arrangement may be reversed and the inner sleeve may be provided with a spiral slot and the outer sleeve with a plurality of spaced apertures. All that is required is a pattern of openings such that when relatively rotated the openings in the sleeves align at different longitudinal positions so as to generate jets at different positions depending on the relative positions of the sleeves. FIG. 12*d* shows a variant in which outer sleeve 121 is provided with a plurality of apertures 124 along a spiral path instead of a single slot. It will be appreciated that this may also be achieved by relative longitudinal movement between the sleeves with appropriately positioned openings.

It will be appreciated that nozzle of any one of the embodiments shown in FIG. 11 and FIGS. 12*a* to *d* may be employed in the paint roller cover cleaner of the type shown in FIGS. 1 to 8 by substitution for the nozzle and sliding carriage arrangement.

Figure 13:
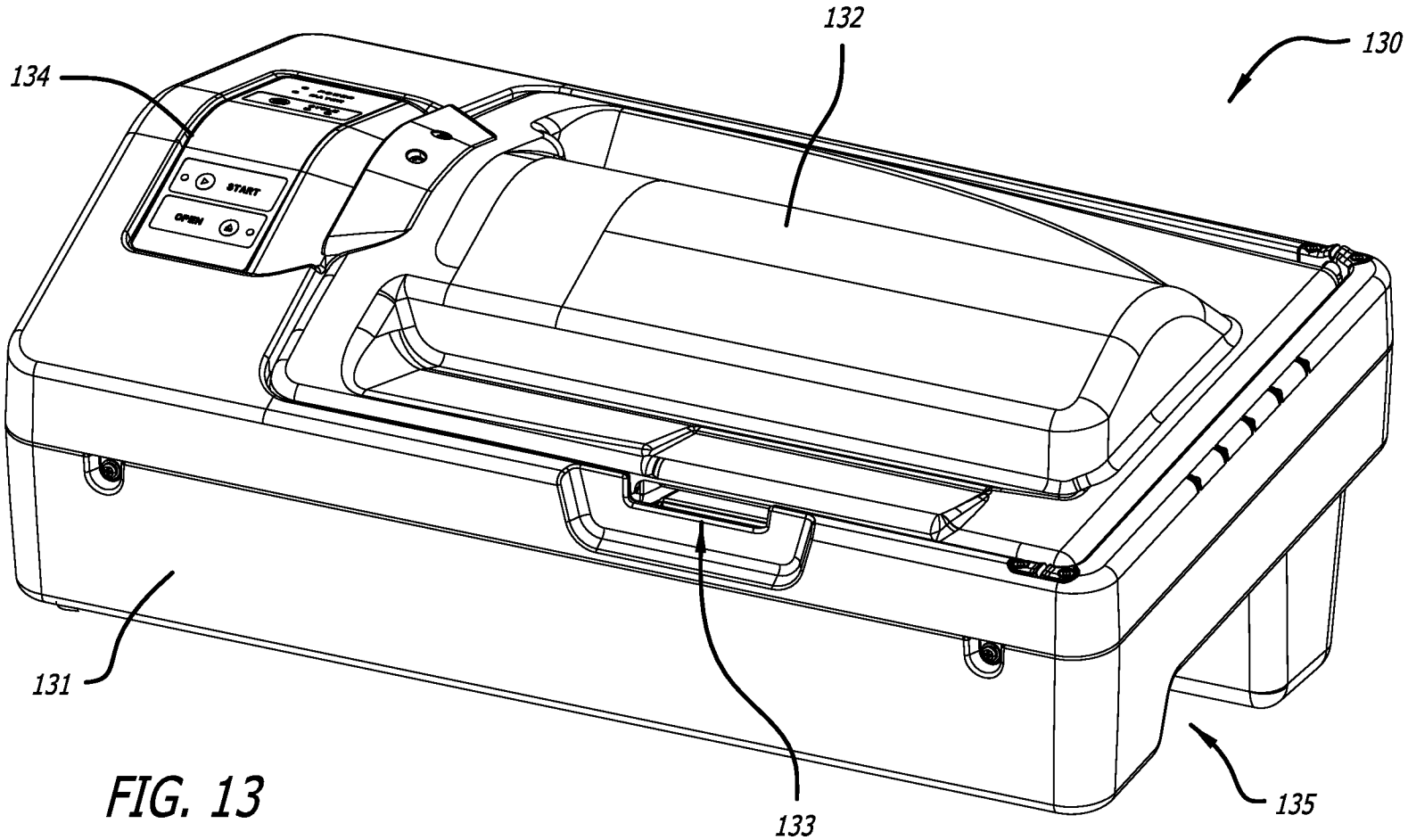
FIG. 13 is a perspective view of a paint roller cover cleaner according to another embodiment.

Another exemplary embodiment of the paint roller cover cleaner is shown in FIG. 13. The cleaner 130 includes a body 131 which is provided with a lid 132. The body 131 and lid 132 form an enclosure for containing the paint roller cover. The body has gap 133 in the area surrounding the opening to allow a handle of an enclosed paint roller to extend out of the enclosure when the lid is closed.

The cleaner also has an instrument panel 134 for controlling operation of the cleaner and/or presenting operational information to the user. The instrument panel may include an on/off switch, a button to start a cleaning process, a button to stop or pause a cleaning process, a button to open or unlock the lid, a button or switch to select one of a plurality of cleaning cycles, a fluid pressure selector or other user input devices. In one example, the instrument panel has a start button to start a cycle, a cycle select button to select the number or type of cleaning cycles to perform, and an open button to allow opening of the lid. In an alternative example, a touch screen may be provided on the cleaner to receive inputs to control multiple operations. In another alternative, some or all of the control commands may be received from a separate user input device such as a mobile phone running a cleaner control app. In this example, external control devices such as buttons and switches on the instrument panel would not be necessary and the cleaner would be provided with a communication module, such as a Bluetooth chip, to receive commands.

The instrument panel may also include outputs for presenting operational information. These may be visual indicators, auditory indicators or tactile indicators. These may indicate information such as whether the power is on or off, whether a fluid supply is connected, whether the machine is performing a cleaning process, whether a cleaning process has been paused or stopped or has finished, whether the lid is unlocked or locked, whether the lid is properly closed or not, which cleaning cycle is selected or being performed, the current or selected fluid pressure, whether there is a fault, or other conditions. In one example, the outputs are lights. In one example, the outputs indicate whether the cleaner is provided with power or not, whether the cleaner has a supply of fluid or not, which number or type of cycle has been selected, whether the cycle has started or not, and whether the lid is open or closed. In the example of FIG. 1, a separate light is provided to indicate each of these conditions. In an alternative example, a single output device such as a digital display screen could indicate multiple conditions. In this example, the display screen could be a touchscreen that also receives user inputs. In an alternative example, the outputs could be provided to a separate device such as a mobile phone running a cleaner control/monitoring app. In this example, external indicators such as lights on the instrument panel would not be necessary and the cleaner would be provided with a communication module, such as a Bluetooth module, to transmit condition indications.

FIG. 13 shows a recess 135 at the bottom of the body. This recess provides space for the connection to a waste fluid reservoir as will be described in more detail with reference to FIG. 21.

Figure 14:
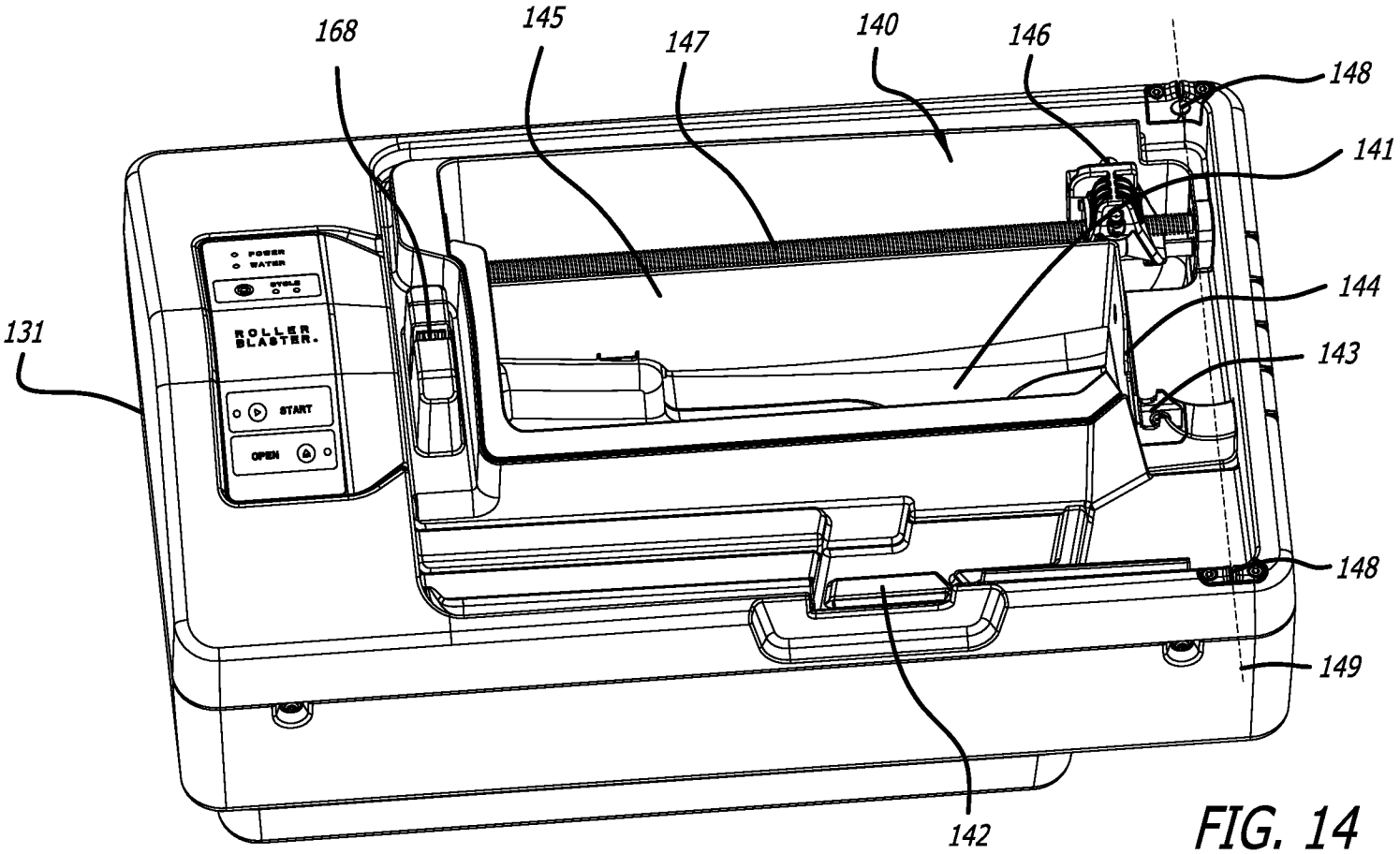
FIG. 14 is a perspective view of the paint roller cover cleaner of FIG. 13 with the lid removed.

FIG. 14 shows the base 131 of the cleaner with the lid removed. In this view, the cavity 140 within the enclosure can be seen. A drain 141 is formed in the body 131 at the bottom of the cavity 140 to drain fluid out of the cover cleaner via an outlet (shown in FIG. 21). A spray head 146 is provided in the enclosure for directing a jet of fluid at the nap of the roller cover to rotate and clean the roller cover. In this example, the spray head is in the form of a carriage that moves along rod 147 to sequentially spray the roller cover at different positions as it moves along the rod. In this example, the carriage will typically move continuously and spray continuously such that the plurality of positions is a continuous line of positions that are sequentially sprayed as the jet moves along the line. In alternative examples, an arrangement as shown in one of FIGS. 11 and 12*a*-12*d* could be used to sequentially spray the roller cover at a plurality of positions. For example, a set of individually controllable nozzles may be arranged along a line to spray the roller cover at respective positions. These nozzles may be activated in sequence to sequentially spray the roller cover at the respective positions. The spray head may also be used to clean the enclosure. A shield 145 is also provided within the enclosure to keep paint and cleaning fluid out of sensitive or hard to clean areas of the enclosure. In particular, the shield in this example shields the region around the spray head 146 and rod 147 to prevent paint or fluid expelled from the cover during cleaning from entering this region. Paint build up on the spray head, threaded rod 147 or other parts of the movement mechanism could cause the spray head to jam and restrict its movement. The shield also prevents the fluid from getting onto or behind the nozzles where they can't clean. This may be achieved by having the upper edge of the shield high enough to block any fluid or paint that would enter this region.

The body of the cleaner includes a shelf 142 and U-shaped slots 143 that act as guide portions to assist positioning of the handle of the paint roller and, in combination with guide portions of the lid, clamp the handle at two different points along the handle to restrict its movement in two transverse directions (laterally and vertically) and hold it in a cleaning position. A notch 144 is also formed in a side wall of the enclosure to act as a positioning guide to restrict the handle's movement in a third direction transverse to the other two transverse directions, i.e. the longitudinal direction. The clamp arrangement maintains the roller cover in a substantially fixed position and orientation during cleaning. The notch maintains the roller cover at a substantially fixed distance from the spray head during cleaning. If the roller cover is too close to the nozzle it could be damaged, but if it is too far it may not clean properly, it may not spin during cleaning, or the jet may not hit the right part of the roller cover. If the roller cover is not in the right orientation during cleaning, the jet might not reliably hit it at the right height or angle.

Figure 15:
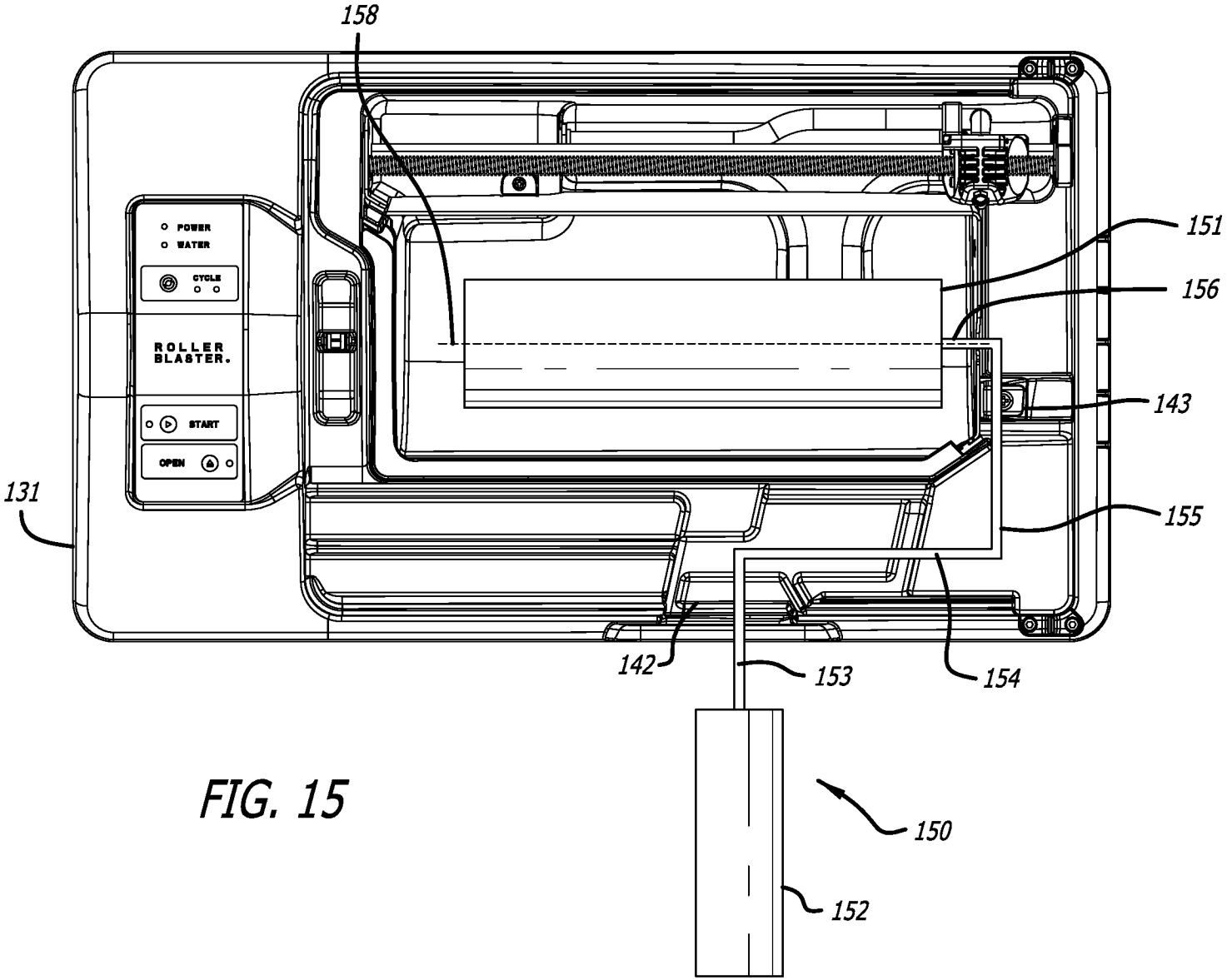
FIG. 15 is a top view of the paint roller cover cleaner of FIG. 13 with the lid removed and a paint roller cover and handle in place on the cleaner.

In particular, the paint roller may be located on the base 131 as shown in FIG. 15. The paint roller includes a roller cover 151 and a handle 150. The handle 150 includes a hand grip 152, and a frame including bars 153, 154, 155 and 156. Typically, the handle also includes a cage rotatably attached to bar 156 which is inserted into the cover 151 to rotatably mount it to the handle 150. Bar 153 is approximately parallel to the hand grip 152. Bar 155 is also approximately parallel to the hand grip but is offset from it (laterally, in the orientation of FIG. 15) such that the hand grip can be roughly centred on the roller cover and the bar 155 can be located beyond the end of the roller cover. The bars 153 and 155 are connected by bar 154. In this example, the bar 154 is at approximately 90° to the bars 153 and 155, but in other examples the bar 154 may be at other angles to the bars 153 and 155 due to deformation resulting from use, manufacturing tolerances or differences in design. These variations may be difficult to accommodate in other devices.

Referring to FIGS. 14 and 15, bar 153 may be supported on the shelf 142 so that the handle can be clamped near the hand grip. Bar 155 lies in the slots 143 so that the handle can be clamped near the roller cover. The slots 143 may be spaced apart from each other along the length of the handle by between about 5 mm and about 100 mm, or by between about 10 mm and about 50 mm. Bar 156 lies in the notch 144. Roller handles can have varying overall sizes, lengths of bars and varying angles between bars due to deformation due to use, different designs and manufacturing tolerances. For this reason, the shelf 142 is made to accommodate a bar 153 at a range of positions across its width and at a range of angles. The two slots hold the bar 155 at a relatively precise angle to ensure that the roller cover is optimally oriented for cleaning. The notch 144 engages the bar 156 at a relatively precise position to ensure that the roller cover is at a suitable distance from the cover-cleaning nozzle. With the roller positioned in the required position the shelf 142 is able to accommodate variations in roller geometry.

FIG. 16 shows the underside of the lid 132. The lid includes blocks 161 and 162 that also act as guide portions to restrict the movement of the handle at the two different points along the handle. The blocks 161 and 162 cooperate with the shelf 142 and slots 143 respectively to clamp the handle when the lid is closed. In particular, when the handle is placed on the base of the cleaner as shown in FIG. 15, the lid can be closed so that the blocks press down on the handle at the points where it lies on the shelf 142 and in the slots 143, clamping it tightly in place. The shelf and block 161 prevent substantial vertical movement of the portion of the handle that is between them. The slots and block 162 prevent substantial lateral movement of the portion of the handle that is in the slots. The notch 144 also prevents substantial longitudinal (forwards and backwards) movement of the portion of the handle that is in the notch. In alternative arrangements, the guides for bars 153 and 155 may be formed completely on one or the other of the body and the lid, rather than from cooperating guide portions on the body and the lid. For example, each of the guides could be a single clip or bracket on the body or the lid.

The clamp also prevents substantial twisting of the handle during cleaning. Cleaning jets may apply significant off-centre forces to the cover and handle, causing torques that could twist the cover out of an optimal cleaning orientation without adequate clamping. This may be particularly problematic when high-pressure jets are used or when using a focused jet that is moved along the cover rather than many jets arrayed along the length of the cover. The clamp described above may ensure the cover remains in a good orientation for cleaning in these situations.

The blocks may be formed from resilient, flexible and/or compressible material. This may improve clamping of handles of different sizes. This may also reduce the vibration of the roller cover and the cover cleaner. In particular, if the handle is clamped too firmly, the cover cleaner may vibrate excessively, but if the handle is clamped too loosely, the cover may vibrate too much to clean properly. In one example, the blocks are rubber.

In alternative examples, a roller cover may be cleaned when removed from the handle. In these examples, the cover cleaner may include a holder for a removed roller cover. For example, the cover cleaner may have a cage similar to the cage of a paint roller handle within the enclosure. The cage may be removable or hinged at one side to allow a user to slide a roller cover on and off. Alternatively, spring-loaded cones may be provided in the enclosure for insertion into respective ends of the roller cover to hold it during cleaning.

In some examples, a roller cover may be cleaned in other orientations. For example, it may arranged in a cover cleaner with its longitudinal axis vertical. In such examples, the cover cleaner may not require a lid at the top, because there will not be a substantial amount of fluid expelled from the roller in the upwards direction. In these examples, the enclosure is formed by the body without a lid. Cover cleaners that clean removed roller covers may be particularly suitable for cleaning vertically disposed covers.

In FIG. 14, hinge sockets 148 are shown at the side of the enclosure 141. These are arranged to receive the hinge pins 163 of the lid, shown in FIG. 16. When the lid is attached to the body via the hinge pins and hinge sockets, the lid is configured to hinge about hinge axis 149 between a closed position in which it closes the mouth of the enclosure (as shown in FIG. 13) and an open position to leave the mouth of the enclosure open (similar to the arrangement shown in FIG. 7). In the open position, the lower portion of the inner surface of the lid is aligned with the mouth of the enclosure. Depending on the configuration of the lid and hinge, the lower edge could be above, below or level with the mouth. This means that any fluid falling from the lower portion will fall into the cavity of the enclosure. This helps to keep cleaning fluid and paint within the cleaner and prevent soiling of the outside of the cleaner or the surroundings when the lid is opened.

The lid is arranged to move in a path parallel to the plane defined by the longitudinal axis of the roller cover and the vertical direction when moving from the closed position to the open position. In other words, the movement of the lid can be rotation, translation, or a combination of translation and rotation in the longitudinal direction of the roller and up and down, but the lid does not move horizontally across the width of the roller cover. This means that the portions of the lid that are beyond the sides of the roller cover when the lid is closed do not move over the cover when it is opened. This prevents fluid dripping from these portions onto a cleaned cover when the lid is opened, thereby potentially fouling or wetting it. In the example of FIGS. 14 and 16, the lid is connected to the side of the enclosure towards one end of the roller cover. As the lid hinges upwardly to open, it rotates about the pins 163 on the hinge axis 164 to move in a path that is parallel to the plane defined above. In an alternative examples, the lid could move on linkage arms or slide within runners to allow some translation of the lid as well as, or instead of, rotation. The lid may be hinged at the side where a moving carriage or moving jet ends up at the end of a spraying process. This end of the lid will tend to have more fluid on it than the other end because it was more recently cleaned. The other, drier end will be the one that is located above the roller cover when the lid is open, reducing the likelihood or amount of fluid that drips onto the roller cover after cleaning.

The lid may be designed to naturally direct fluid on the lid away from the region above the roller cover to one or more sides, keeping the area above the cover relatively clean and dry. In the example of FIG. 16, the underside 165 of the lid has a concave curvature as viewed from the side. When the lid is closed, the highest part of the curved inner surface is over the roller cover, with the surface angled downwardly towards the sides. Fluid on the inner surface will therefore run away from the part above the roller cover towards the sides, which are not over the roller cover, and fall into the cavity of the enclosure without soiling the cleaned roller cover.

Also shown in FIG. 14 is a latch 168. This is provided to engage with the latch keeper 166 of the lid 132 (shown in FIG. 16) when the lid is closed. The latch may be a manual, electromechanical or electromagnetic latch.

The spray head is shown in more detail in FIG. 17. The spray head includes roller cover-cleaning nozzle 170. In this example, the spray head also includes enclosure-cleaning nozzle 171. In this example, the spray head is in the form of a carriage that can move along the length of the roller cover to progressively clean the cover. The carriage can move along a guide, for example one or more rods. The carriage in this example is driven along threaded rod 147, which passes through a complementary threaded hole (shown in FIG. 19) in the carriage due to relative axial rotation between the rod and the threaded hole. The carriage also moves along rod 175, which prevents rotation of the spray head about the threaded rod. The rod 175 is not threaded and the carriage slides freely along it.

The cover-cleaning nozzle in this example is configured to produce a fan-shaped jet of fluid. The fan-shaped jet defines a plane 173 extending away from the nozzle ("out of the page" in the view of FIG. 17) and outwardly from the centre of the jet. The plane 173 is at an angle Θ to the roller cover axis 158.

The plane 173 intersects the axis 158 at an angle of between about 5° and about 85°, preferably between about 10° and about 70°. In one example, the angle Θ is about 45°. The plane of the fan jet can be at the angle Θ as measured either clockwise or anti-clockwise from the axis 158, i.e. it can be a positive or negative angle. The inventor has surprisingly found that control of the jet angle allows control of the spin speed of the roller cover, and that certain angles or ranges of angles provide suitable spin speeds that are high enough to provide adequate cleaning and drying of the roller cover but not so high as to damage the roller cover. Specifically, the angle Θ may be selected to cause rotation of roller covers between upper and lower speed thresholds. For a given jet angle Θ within the recited ranges, suitable cover rotation speeds may be attained for a range of different roller cover sizes without the need to adjust other parameters such as the cleaning fluid pressure or jet position. This means that many different covers may be cleaned reliably and without suffering damage using the exact same configuration of the roller cover cleaner.

Figure 18:
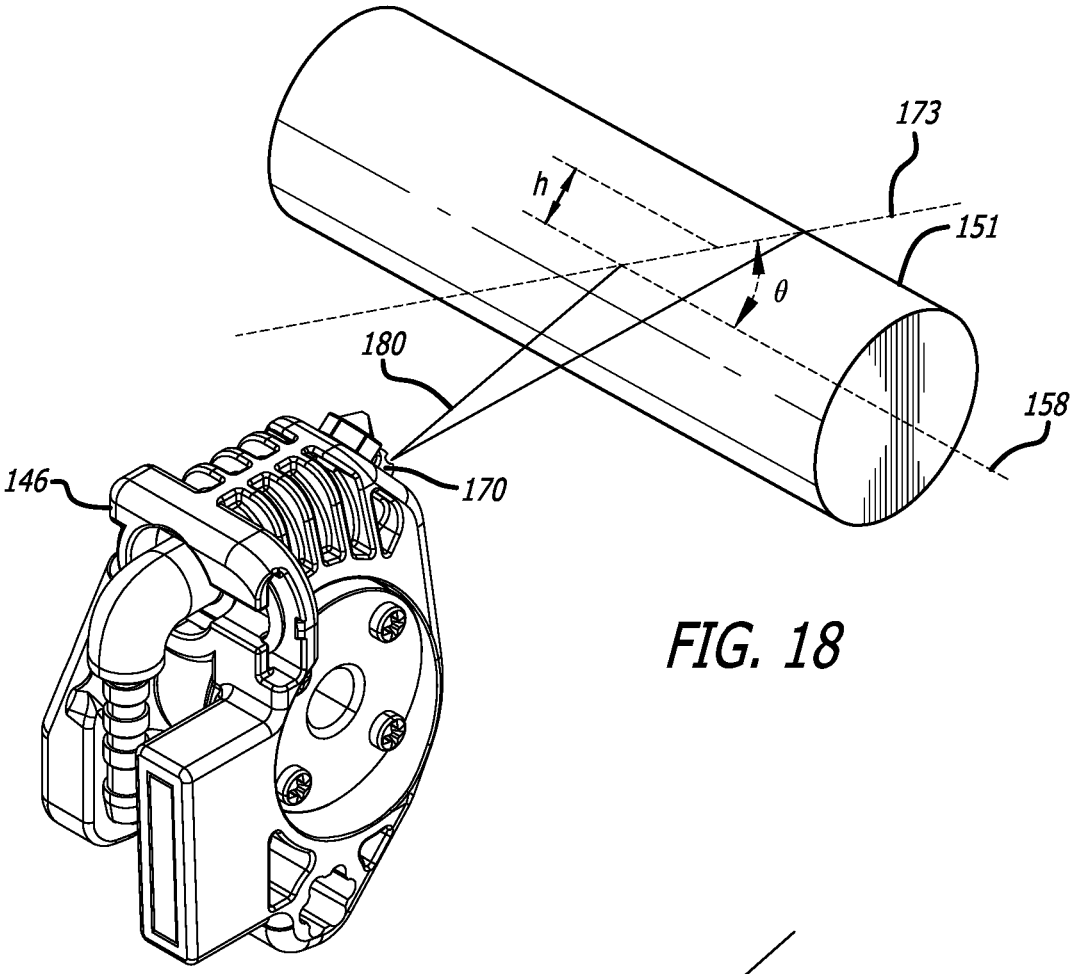
FIG. 18 is a perspective view of a jet from a cleaning nozzle impacting a paint roller cover according to one embodiment.

FIG. 18 shows the fan jet 180 produced by the cover-cleaning nozzle 171 being applied to a roller cover. The plane 173 is also shown intersecting the longitudinal axis 158 at the angle Θ. The jet is centred on a line that is substantially parallel with the hand grip 152 and bar 153 of the roller handle. This is the preferred direction for the jet because different roller handles can have quite different angles between their bars, which means that the roller covers may be at a relatively wide range of angles in the plane of the handle. If the jet were directed downwards (or upwards) at the roller cover, it might not reliably hit the roller cover at the right distance from the longitudinal axis and could even miss it altogether. Because the bars of handles are not bend out of the plane of the handle during manufacture, the roller covers typically lie quite reliably in this plane, so a jet that is substantially parallel to the grip may reliably hit the cover at a predictable position with respect to the longitudinal axis. The jet is also centred on a point at a height h between 14 mm and 21 mm above the longitudinal axis of the roller cover. This may help control the speed of rotation of the roller cover between the upper and lower speed thresholds, ensure the spray properly hits and penetrates the nap, minimise vibrations and properly spin the cover to facilitate drying.

The fan-shaped jet spreads and increases in width with increasing distance from the nozzle. At the roller cover, it has a width between about 5 mm and about 100 mm, preferably between about 5 mm and about 50 mm. The width is low enough that the jet is sufficiently concentrated in one area to penetrate well into the nap of the roller cover but high enough that the jet is not so concentrated in one area that it damages the nap.

Figure 19:
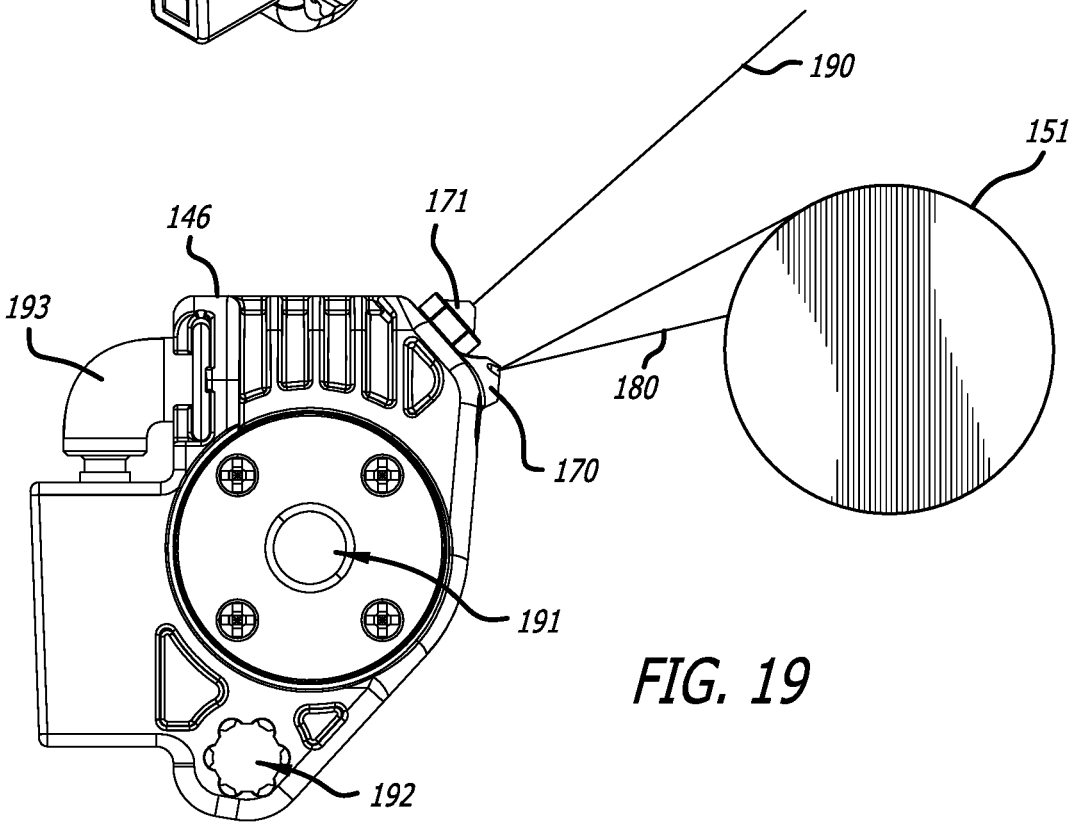
FIG. 19 is a side view of the spray assembly of FIG. 17, showing roller cleaning and enclosure cleaning jets and a paint roller cover.

FIG. 19 shows the spray head in from the side, as well as the cover-cleaning jet 180 and the enclosure-cleaning jet 190.

The enclosure-cleaning nozzle 171 produces a jet of fluid that is directed onto an inner surface of the enclosure to remove paint and soiled cleaning fluid. This minimises build-up of paint in the enclosure and minimises any contact between the user and paint or soiled fluid. In this example, the nozzle is configured to produce a tight beam of fluid, i.e. a beam jet, but in other examples the nozzle could produce a fan jet.

The enclosure-cleaning nozzle 171 is located above the cover-cleaning nozzle 170 in this example, however it could be also or additionally be laterally offset from the cover-cleaning nozzle. The enclosure-cleaning nozzle 171 produces a jet of fluid that is directed at the interior of the enclosure, rather than at the roller cover.

The enclosure-cleaning nozzle can be moved about the cavity of the enclosure to direct the jet 190 at different areas of the enclosure. For example, the enclosure-cleaning nozzle may be carried on a carriage. The enclosure-cleaning nozzle and the cover-cleaning nozzle may also be ganged together for common movement, for example by being connected to each other by a bar or a cord, by being driven by common drive means, or by being carried on the same carriage. In this example, the enclosure-cleaning nozzle is on the spray head 146, which is in the form of a carriage that also includes the cover-cleaning nozzle 170. This allows the enclosure-cleaning jet to progressively clean the enclosure and the cover-cleaning jet progressively cleans the cover as the carriage moves along the length of the roller.

The enclosure-cleaning jet can be arranged to clean various regions and surfaces of the enclosure, for example the lid, side walls and bottom. In one example, the enclosure-cleaning nozzle is directed at the lid. The cleaning jet can move across substantially the whole width of the lid to clean substantially its entire inner surface. This may be beneficial because the lid is commonly contacted by users (e.g. when opening and closing the lid) and is typically positioned above the roller cover. Keeping the lid clean may minimise the amount of paint and soiled cleaning fluid that users come into contact with and stop it dripping onto a cleaned roller cover.

The enclosure-cleaning jet may be arranged to hit the inner surface of the enclosure at a low angle and cling to the inner surface. The low angle is one that allows the majority of the enclosure-cleaning jet to cling to the inner surface. The precise angle may depend on the cleaning fluid used, the speed or pressure of the jet, the nature of the inner surface and other factors. In one example, it has been found that an angle of between about 1° and 45°, or about 10°, is suitable. This may be particularly; suitable when the cleaning fluid is water and the jet is produced by a fluid source of between about 200 psi and about 4000 psi. This means that the jet can clean a relatively large area of the inner surface as it clings to and travels over the surface, rather than just the area that it strikes. The interior of the enclosure may be designed to assist this process, for example by having relatively large flat or concave surfaces that allow the cleaning fluid to travel across the surfaces. For example, the concave inner surface of the lid (165 in FIG. 16) may allow the enclosure-cleaning jet to cling to and travel over a large area of the lid to thoroughly clean it.

Cleaning fluid is provided from a fluid supply via supply hose 193. In this example, a single fluid supply provides cleaning fluid to both nozzle 170 and 171. Because the nozzles have a common fluid supply, the flow through each nozzle affects the flow through the other nozzle. In particular, adjusting the orifice size of the enclosure-cleaning nozzle changes the pressure of the cover-cleaning jet. More generally, changing the enclosure-cleaning nozzle changes the pressure and flow rate of the enclosure cleaning nozzle and the pressure(s) and flow rate(s) of the roller cover-cleaning nozzle or nozzles. The enclosure-cleaning nozzle may be replaceable so that a user can exchange the enclosure-cleaning nozzle for another one with a different orifice size. This allows the user to adjust the pressure of the cover-cleaning jet without having to replace the cover-cleaning nozzle, which may be harder to access than the enclosure-cleaning nozzle. In the case in which there is more than one roller cover-cleaning nozzle, replacing the enclosure-cleaning nozzle may similarly affect the flow through all of the roller-cover cleaning nozzles. The user could also exchange the enclosure-cleaning nozzle for one that produces an enclosure-cleaning jet of a different shape, pressure or angle. A flow controller may also be provided to control the flow of cleaning fluid to the cavity-cleaning nozzle, thereby also controlling flow to the roller cover-cleaning nozzle.

The spray head includes a threaded hole 191 for receiving the threaded rod 147 of FIG. 17. This forms a lead screw that converts relative rotation between the threaded rod and threaded hole to translation along the rod. The spray head also has a guide hole 192 for receiving the rod 175, which prevents rotation of the spray head about the threaded rod. The relative rotation of the threaded rod and threaded hole could be produced by rotating one or both of the rod and the threaded hole. Alternatively, one of the drive arrangements of FIGS. 5-7 could be used to drive the carriage.

Figure 20:
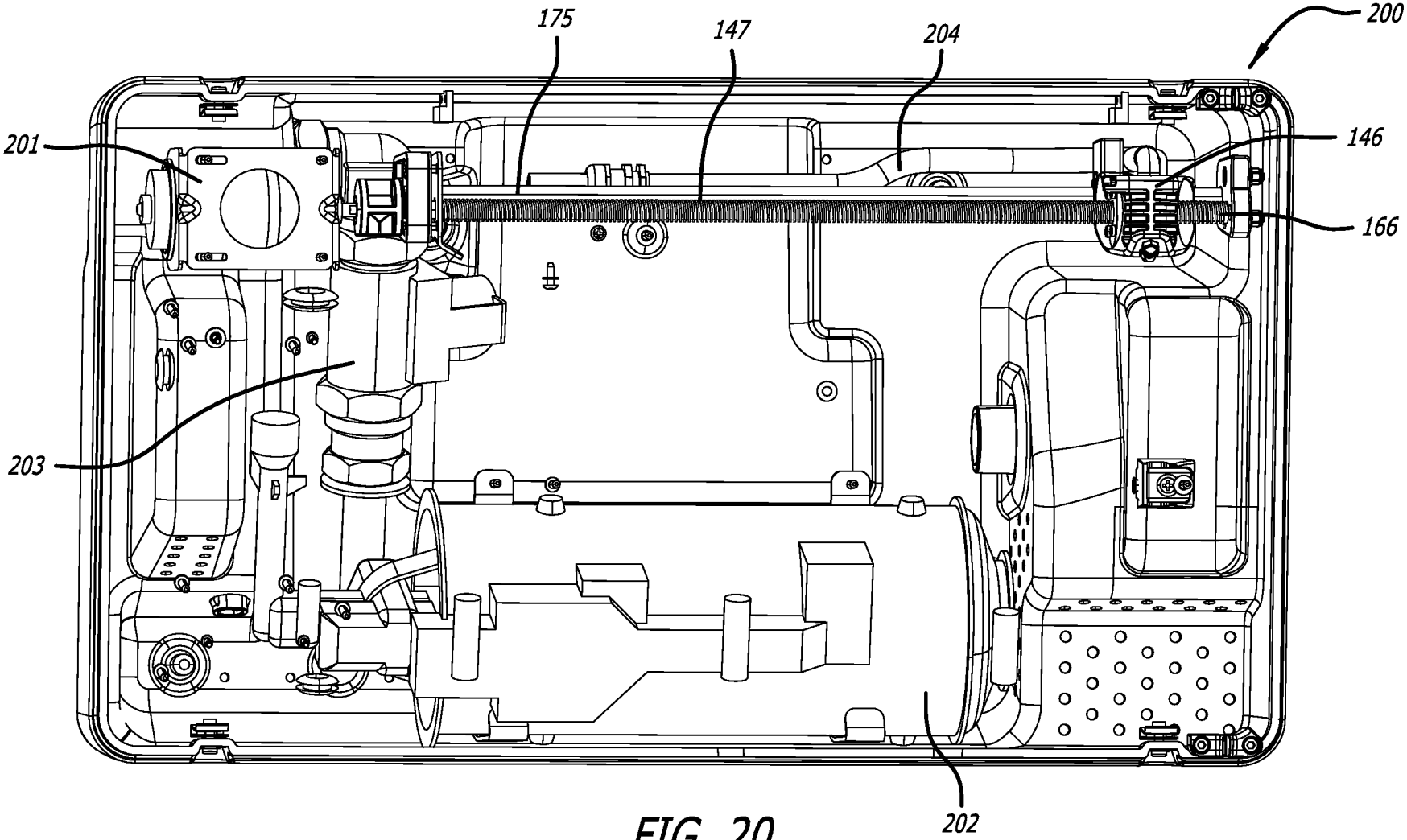
FIG. 20 is a top view of the internal components of the paint roller cover cleaner of FIG. 17.

FIG. 20 shows internal workings 200 of the roller cover cleaner. The spray head 146 is carried on the threaded rod 147 and rod 175, which is not threaded. In this example, the threaded rod 147 is rotated to drive motion of the spray head through the cavity of the enclosure, for example using an electric motor. In FIG. 20, rotation is provided by DC motor 201. In other examples, rotation of the rod or threaded hole may be driven by pressurised cleaning fluid.

Pump 202 provides pressurised cleaning fluid to the spray head 146 via hose 204. Because of the use of a moving high-pressure jet, rather than an array of many jets, a relatively low flow rate of fluid is required during cleaning. This means that a relatively small pump may be sufficient to produce the pressurised fluid supply. The pump may be configured to produce a high pressure fluid supply, for example between about 200 psi and about 4000 psi (or between about 1400 kPa and about 28000 kPa), preferably between about 400 psi and about 3000 psi (or between about 2800 kPa and about 21000 kPa). In this example, the pump is a piston pump, which may be particularly suitable for produced fluid at these pressures. The pump may be a self-priming pump which may allow it to pump fluid from a reservoir without needing priming. In alternative arrangements, fluid may be supplied at a suitable pressure by an external source without the need for a pump in the cover cleaner. The external source could be a pump or a mains water supply if the mains pressure is adequate.

Figure 21:
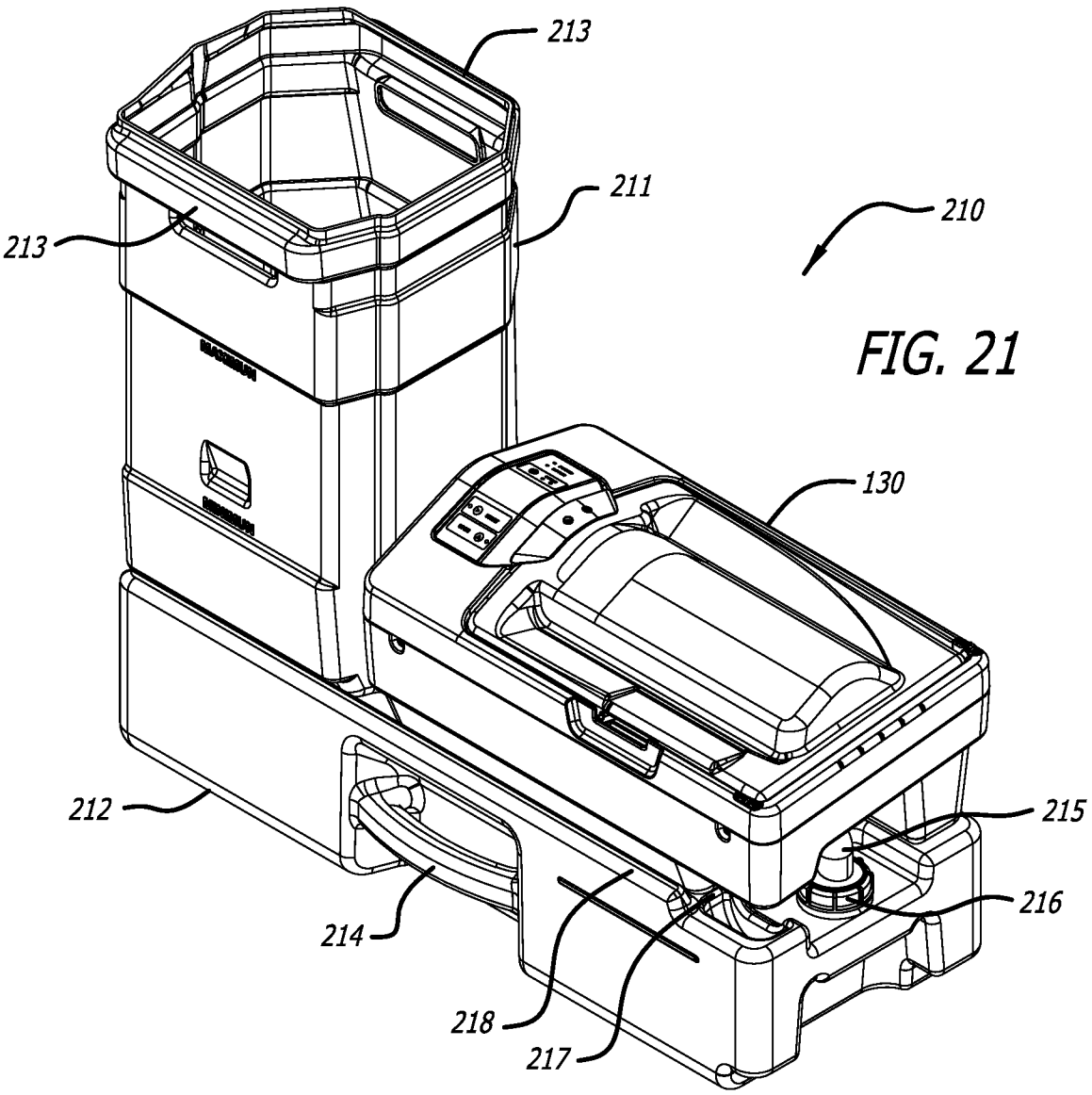
FIG. 21 is a perspective view of the front of a paint roller cover cleaning system according to one embodiment.

FIG. 21 shows one example of a roller cover cleaning system 210. The roller cover cleaning system includes a roller cover cleaner 130, a fluid supply reservoir 211 and a waste fluid reservoir 212. Various roller cover cleaners would be suitable for use with the roller cover cleaner system. In this example, the roller cover cleaner is the roller cover cleaner 130 as detailed with reference to FIGS. 13-20.

The fluid supply reservoir 211 is configured to hold enough fluid to perform at least one cleaning operation. In one example, the fluid supply reservoir 211 holds at least enough fluid to clean one roller cover. In one example the fluid supply reservoir holds enough fluid to clean several roller covers. The fluid supply reservoir may be portable. The fluid supply reservoir may include one or more handles 213 for a user to carry it by—in this example there are two handles 213.

The waste fluid reservoir 212 is configured to hold the waste fluid produced in at least one cleaning operation. In one example, the waste fluid reservoir can hold at least as much waste fluid as is produced cleaning one roller cover. In one example, the waste fluid reservoir can hold the waste fluid produced by cleaning several roller covers. The waste fluid reservoir may be portable. In this example, the waste fluid reservoir includes one or more handles 214 for a user to carry it by. The waste fluid reservoir 212 has an inlet coupling 216 that connects to the outlet coupling 215 of the cover cleaner 130 to collect waste fluid from the cover cleaner 130.

The waste fluid reservoir may act as a support base for the roller cover cleaner in use. The waste fluid reservoir may act as a support base for the fluid supply reservoir in use. In the example of FIG. 21, the waste fluid reservoir supports both the fluid supply reservoir and the roller cover cleaner. The upper surface of the waste fluid reservoir in this example includes recessed areas 217 that the bases of the fluid supply reservoir 211 and roller cover cleaner 130 can sit on. The recessed areas are surrounded by raised or non-recessed areas 218 that help retain the fluid supply reservoir and cover cleaner on the waste fluid reservoir in use.

Figure 22:
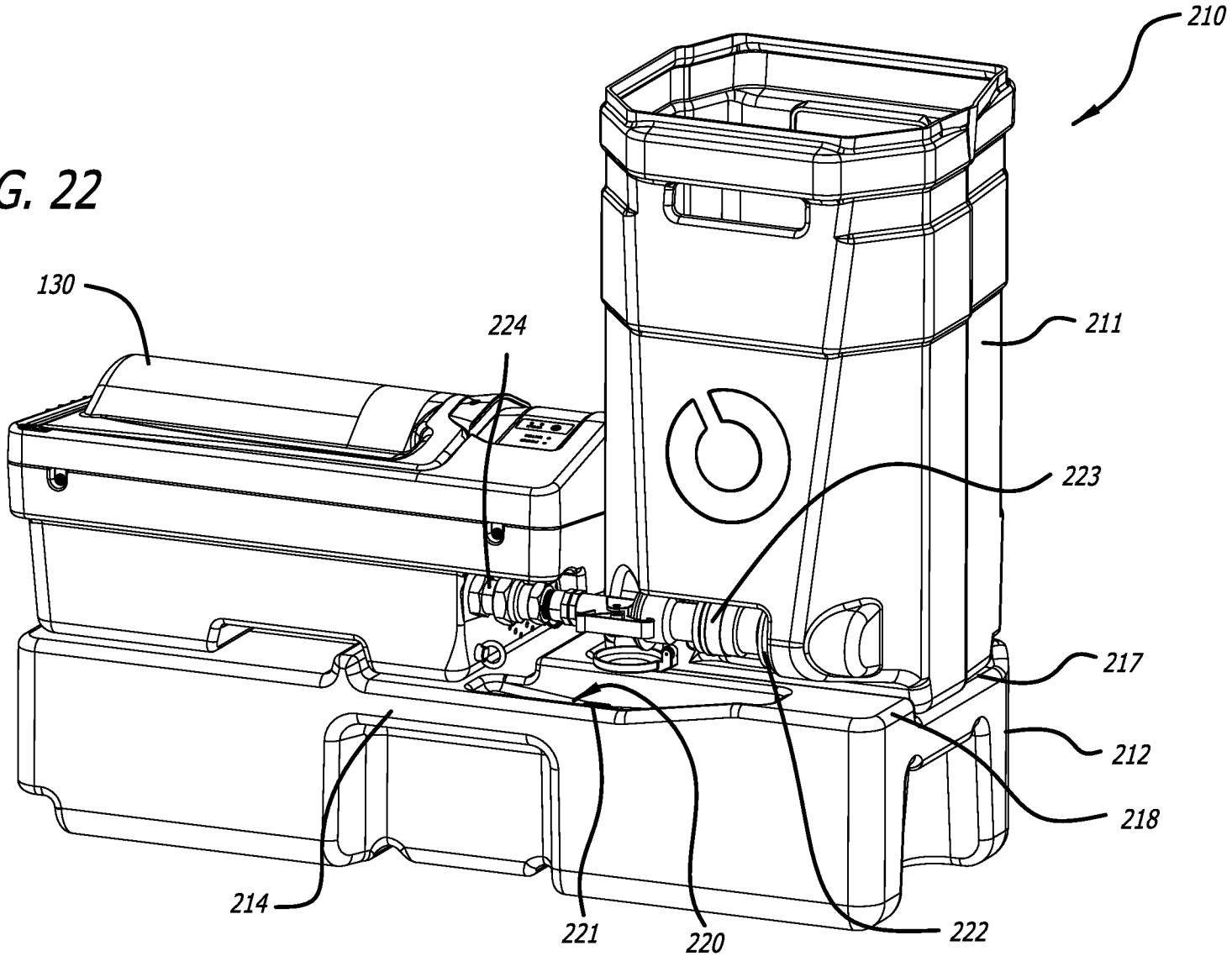
FIG. 22 is a perspective view of the back of the paint roller cover cleaning system of FIG. 21.

FIG. 22 shows the system 210 from the other side. This view also shows the fluid supply reservoir 211, waste fluid reservoir 212 and roller cover cleaner 130. A second handle 213 can be seen on this side of the fluid supply reservoir, as well as further recessed areas 217 and raised or non-recessed areas 218.

The fluid supply reservoir has an outlet 222 that connects to the inlet 224 of the cover cleaner 130 to provide cleaning fluid to the cover cleaner 130. The fluid is supplied to the pump (shown in FIG. 20) of the cover cleaner 130 such that inlet 224 is an inlet to the pump. In the working orientation, the outlet 222 from the fluid supply reservoir is higher than the inlet 224. This may allow any air in the fluid line to float out of the water line via the outlet 222 to prevent air locking of the pump.

A valve 223 is provided between the fluid supply reservoir outlet 222 and the cover cleaner inlet 224. This is biased towards a closed position to automatically close upon disconnection of the outlet 222 from the roller cover cleaner to prevent excessive loss of cleaning fluid from the fluid supply reservoir. In one example, the valve 223 is a quick connect valve.

The waste fluid reservoir in this example also has a cavity 220 formed in its upper surface below the connection between the fluid supply reservoir and the cover cleaner. This collects fluid that spills when the fluid supply reservoir is disconnected from the cover cleaner. The cavity is provided with a bung 221 that can be removed from an inlet 225 at the base of the cavity to allow fluid to flow from the cavity into the waste fluid reservoir and inserted into the inlet to retain fluid in the waste fluid reservoir.

The inlet 224 of the roller cover cleaner 130 is provided with a normally closed valve 203. This controls flow of fluid from the inlet to the pump and stops fluid from flowing through the cleaner when it is not in use or is switched off, without the need for power. The valve 203 may then be opened at the beginning of a cleaning cycle and allowed to close again at the end of the cycle. Additionally, the valve 203 will automatically close and prevent fluid flow through the cover cleaner upon occurrence of certain faults, such as a power failure or lid failure. In this example, the valve 203 is a solenoid valve.

Figure 23:
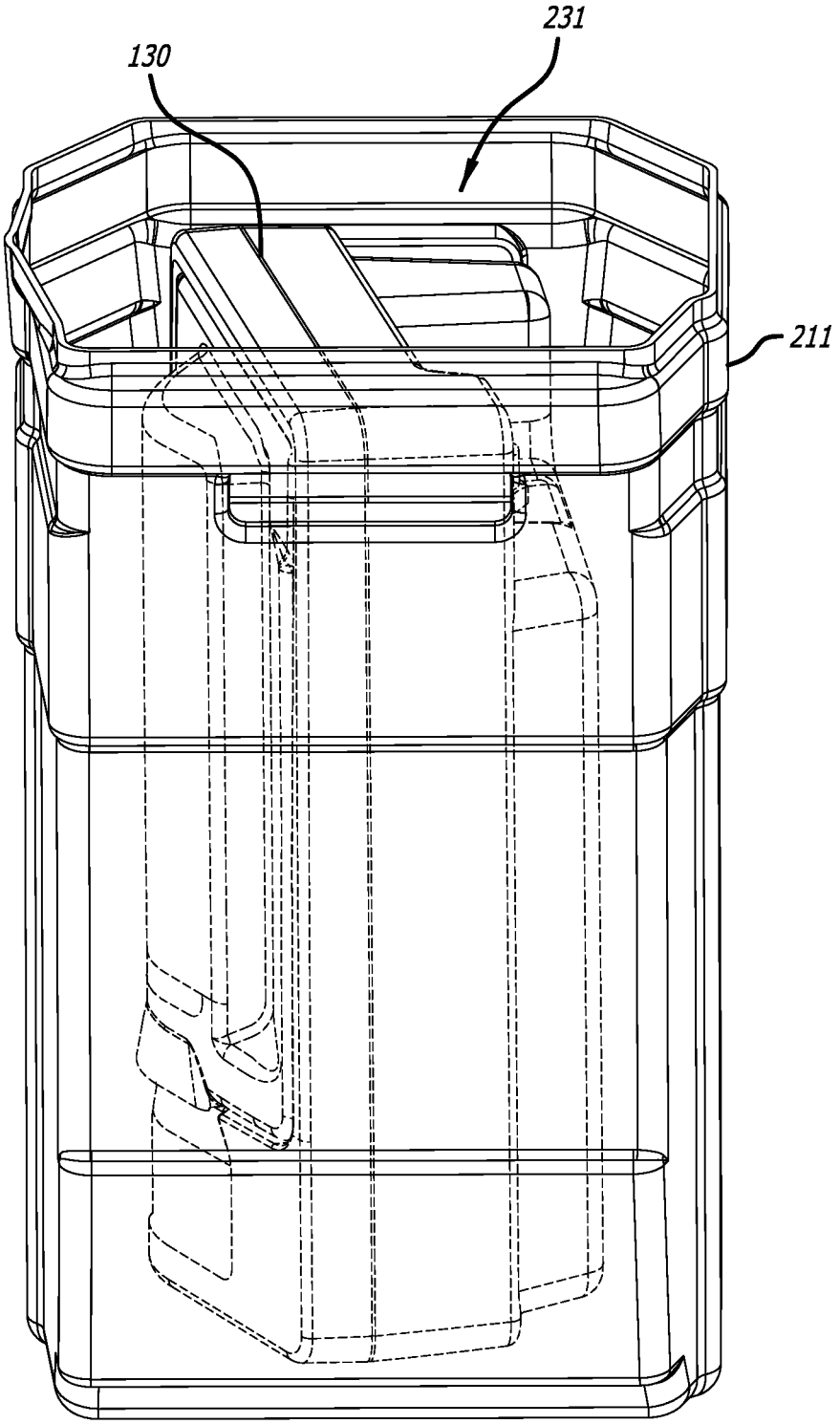
FIG. 23 is a perspective view of a paint roller cover cleaner located within a fluid supply reservoir of the paint roller cover cleaning system.

As shown in FIG. 23, the fluid supply reservoir has an internal cavity 231 that is dimensioned to accommodate the cover cleaner 130 within it. This may allow the roller cover cleaner to be stored or transported in the fluid supply reservoir. This may save space, protect the roller cover cleaner and make the cover cleaner easier to carry using the handles 213. The entire system is portable by hand—the user can carry the fluid supply reservoir by handles 213, the waste fluid reservoir by handles 214, and can carry the cover cleaner either in the fluid supply reservoir or separate from it. This may obviate problems with other cleaners that may not be easily transportable or may suffer damage during transport, for example in a vehicle.

There is thus provided a paint roller cover cleaner that may quickly (typically within 30 seconds) and effectively clean a wide range of rollers. The user is not required to remove excess paint from sleeve before cleaning due to the effectiveness of the high pressure jet. No pressured external water supply is required and the device typically uses less than 4 litres of water, compared to 20 to 300 litres for a typical prior art system. This low water use makes recycling a viable option and enables cleaning fluid and waste fluid to be self-contained and easily transportable.

Due to the high pressure jet and high speed of rotation a cleaned roller cover is almost completely dry after cleaning which enables a painter to reuse the roller cover immediately. Due to the highly effective cleaning there is virtually no left over paint residue which eliminates cross contamination should the painter reuse the roller sleeve immediately.

There is also provided a roller cover cleaner and system that may accommodate roller covers of different sizes or handles of different geometries, may ensure that roller covers, external surfaces and sensitive areas, and surroundings of the cleaner are not fouled by waste fluid or paint, may maintain roller covers in optimal cleaning positions/orientations while reducing vibrations, and may be well suited to being transported.

While the present invention has been illustrated by the description of the embodiments thereof, and while the embodiments have been described in detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the applicant's general inventive concept.

EXEMPLARY EMBODIMENTS

According to another exemplary embodiment there is provided a paint roller cover cleaner comprising:

a. an enclosure that may be opened to place a roller cover within the enclosure and closed to contain the roller cover within;
b. a high pressure pump capable of producing a fluid supply at a pressure of between 200 to 4000 psi;
c. a nozzle supplied with pressurised fluid from the pump positioned to direct a jet of fluid at the nap of the roller cover to rotate the roller cover and facilitate cleaning; and
d. a carriage that moves the nozzle along the length of the roller cover to effect cleaning along the length of the roller cover.

According to another exemplary embodiment there is provided a paint roller cover cleaner comprising:

a. an enclosure that may be opened to place a roller cover within the enclosure and closed to contain the roller cover within;
b. a clamp which clamps a roller handle to the enclosure so that the roller handle is external to the enclosure and the roller cover is held in a desired position within the enclosure;
c. a high pressure pump;
d. a nozzle supplied with pressurised fluid from the pump positioned to direct a jet of fluid at the nap of the roller cover to rotate the roller cover and facilitate cleaning; and
e. a carriage that moves the nozzle along the length of the roller cover to effect cleaning along the length of the roller cover.

According to another exemplary embodiment there is provided a paint roller cover cleaner comprising:

a. an enclosure that may be opened to place a roller cover within the enclosure and closed to contain the roller cover within;
b. a clamp which clamps a roller handle to the enclosure so that the roller cover is held in a desired position within the enclosure;
c. a fluid supply reservoir within the enclosure supplying fluid to the pump;
d. a high pressure pump;
e. a nozzle supplied with pressurised fluid from the pump positioned to direct a jet of fluid at the nap of the roller cover to rotate the roller cover and facilitate cleaning;
f. a carriage that moves the nozzle along the length of the roller cover to effect cleaning along the length of the roller cover; and
g. a waste fluid reservoir within the enclosure for containing waste fluid produced during cleaning.

According to another exemplary embodiment there is provided a paint roller cover cleaner comprising:

a. an enclosure that may be opened to place a roller cover within the enclosure and closed to contain the roller cover within;
b. a high pressure pump capable of producing a fluid supply at a pressure of between 200 to 4000 psi; and
c. a nozzle supplied with pressurised fluid from the pump positioned to direct a jet of fluid at the nap of the roller cover to rotate the roller cover and facilitate cleaning.

The invention claimed is:

1. A paint roller cover cleaner comprising:

an enclosure for receiving a roller cover;

a roller cover-cleaning nozzle configured to direct a first jet of fluid at the nap of the roller cover to facilitate cleaning of the roller cover; and an enclosure-cleaning nozzle configured to direct a second jet of fluid at an inner surface of the enclosure for cleaning the enclosure;

wherein the enclosure-cleaning nozzle is configured to move about a cavity within the enclosure to direct the second jet of fluid at different areas of the interior of the enclosure.

2. The paint roller cover cleaner of claim 1, wherein the roller cover-cleaning nozzle and the enclosure-cleaning nozzle are ganged together for common movement about the cavity.

3. The paint roller cover cleaner of claim 2, wherein the roller cover-cleaning nozzle and the enclosure-cleaning nozzle are mounted on a movable carriage.

4. The paint roller cover cleaner of claim 1, wherein the enclosure-cleaning nozzle is configured to direct the second jet to hit the inner surface of the enclosure at a low angle and cling to the inner surface.

5. The paint roller cover cleaner of claim 1, further comprising a lid to close the enclosure, wherein the enclosure-cleaning nozzle is configured to direct the second jet at the lid.

6. The paint roller cover cleaner of claim 5, wherein the inner surface of the lid has a concave curvature.

7. The paint roller cover cleaner of claim 1, wherein the roller cover-cleaning nozzle and the enclosure-cleaning nozzle are supplied by a common fluid supply.

8. The paint roller cover cleaner of claim 7, wherein the enclosure-cleaning nozzle is replaceable to change the pressure of first jet.

9. The paint roller cover cleaner of claim 7, further comprising a shield within the enclosure to prevent fluid expelled from the cover from entering a region within the enclosure.

* * * * *